US007992857B2

(12) United States Patent
Igata

(10) Patent No.: US 7,992,857 B2
(45) Date of Patent: Aug. 9, 2011

(54) PAPER SHEET HANDLING DEVICE

(75) Inventor: Kazuya Igata, Gunma (JP)

(73) Assignee: Max Co., Ltd., Tokyo (JP)

( * ) Notice: Subject to any disclaimer, the term of this patent is extended or adjusted under 35 U.S.C. 154(b) by 16 days.

(21) Appl. No.: 12/520,942

(22) PCT Filed: Dec. 26, 2007

(86) PCT No.: PCT/JP2007/074985

§ 371 (c)(1),
(2), (4) Date: Jun. 23, 2009

(87) PCT Pub. No.: WO2008/081825

PCT Pub. Date: Jul. 10, 2008

(65) Prior Publication Data

US 2010/0044945 A1 Feb. 25, 2010

(30) Foreign Application Priority Data

Dec. 27, 2006 (JP) ..... 2006-353012
Dec. 27, 2006 (JP) ..... 2006-353013

(51) Int. Cl.
*B65H 39/00* (2006.01)

(52) U.S. Cl. ..... 270/58.11; 270/58.07; 270/58.17

(58) Field of Classification Search ..... 270/52.18, 270/37, 58.07, 58.08, 58.11, 58.12; 412/18, 412/25

See application file for complete search history.

(56) References Cited

U.S. PATENT DOCUMENTS

| | | | | |
|---|---|---|---|---|
| 2,963,049 | A | 12/1960 | Hans Biel et al. | |
| 2005/0179190 | A1 * | 8/2005 | Kamiya et al. | 270/58.07 |
| 2007/0009298 | A1 * | 1/2007 | Nagasawa et al. | 399/410 |

FOREIGN PATENT DOCUMENTS

| | | | |
|---|---|---|---|
| EP | 0572103 | A1 | 12/1993 |
| EP | 1275522 | A2 | 1/2003 |
| JP | 6-166461 | A | 12/1994 |
| JP | 10-307437 | A | 11/1998 |
| JP | 2002-2149 | A | 1/2002 |
| JP | 2002-348017 | A | 12/2002 |

OTHER PUBLICATIONS

Callan, Feargel, European Search Report for EP 07860214, Jan. 5, 2011.

* cited by examiner

*Primary Examiner* — Leslie A Nicholson, III
(74) *Attorney, Agent, or Firm* — Chernoff, Vilhauer, McClung & Stenzel

(57) ABSTRACT

A paper-sheet handling device, as shown in FIG. 23, is a device that transports a bundle of paper-sheets obtained by binding a plurality of paper-sheets and is provided with a clamp movement mechanism 80 that contains lower arms 801*a* and upper arms 801*b* and transports the bundle of paper-sheets with it being fixed. The clamp movement mechanism 80 contains a clamp-opening-and-closing driving section 881 that drives the upper arms 801*b*, the clamp-opening-and-closing driving section 881 is provided with cams 87*a*, 87*b*, and each of the cams 87*a*, 87*b* contains a part having a given curved shape, the part keeping a normal operation range in which the upper arm 801*b* is moved up to a predetermined position with respect to the lower arm 801*a* to release the bundle of paper-sheets 3" and a U-shaped part that keeps a lock position for opening the clamp, the U-shaped part being continuous with the part having the given curved shape. Such a configuration allows a situation in which the upper arms 801*b* are opened to be locked. This enables workability and operability when a jam removes to be improved and enables release of the lock of a manipulation lever to be prevented from being forgotten.

10 Claims, 24 Drawing Sheets

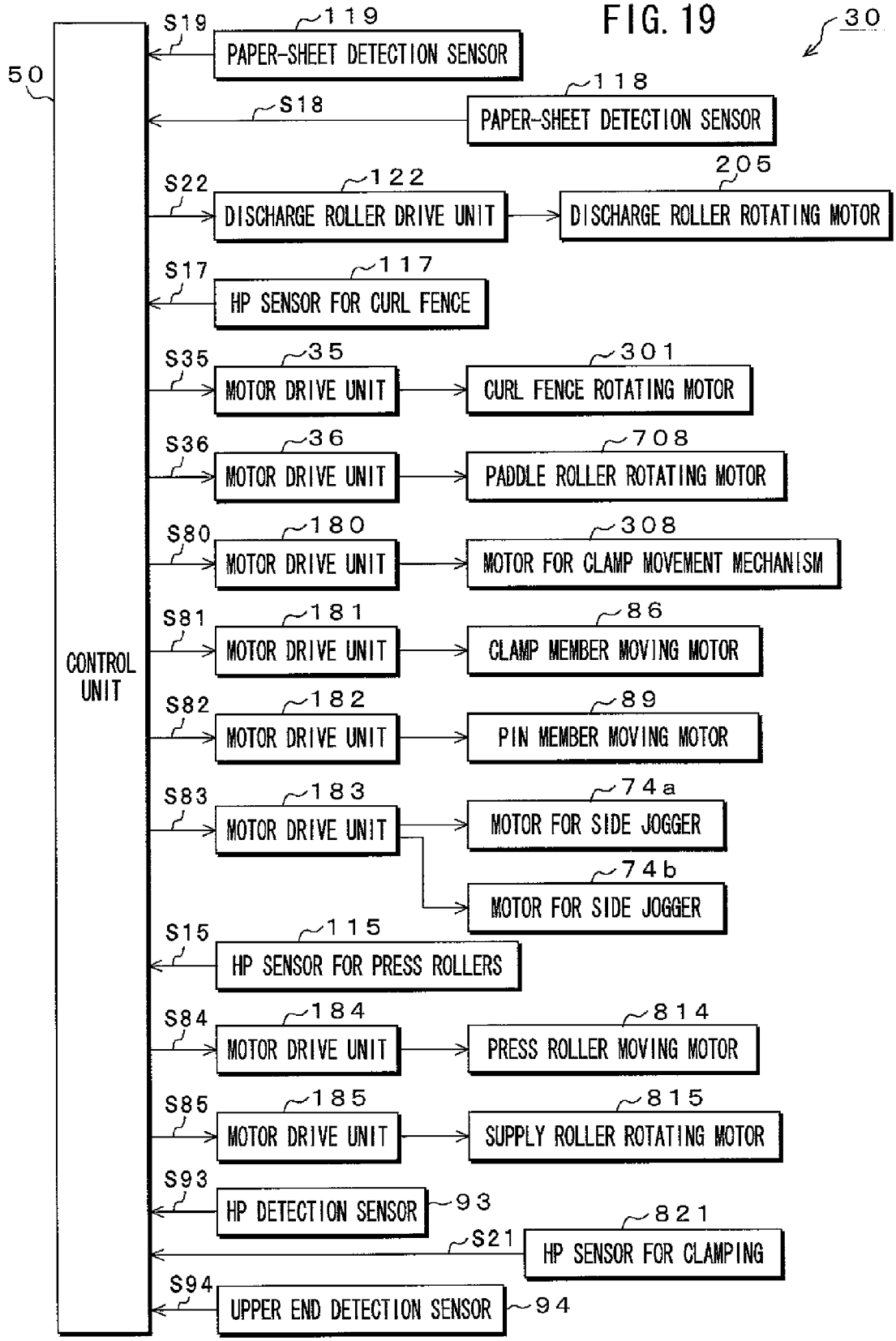
FIG. 19
30
50
CONTROL UNIT
S19
119
PAPER-SHEET DETECTION SENSOR
S18
118
PAPER-SHEET DETECTION SENSOR
S22
122
DISCHARGE ROLLER DRIVE UNIT
205
DISCHARGE ROLLER ROTATING MOTOR
S17
117
HP SENSOR FOR CURL FENCE
S35
35
MOTOR DRIVE UNIT
301
CURL FENCE ROTATING MOTOR
S36
36
MOTOR DRIVE UNIT
708
PADDLE ROLLER ROTATING MOTOR
S80
180
MOTOR DRIVE UNIT
308
MOTOR FOR CLAMP MOVEMENT MECHANISM
S81
181
MOTOR DRIVE UNIT
86
CLAMP MEMBER MOVING MOTOR
S82
182
MOTOR DRIVE UNIT
89
PIN MEMBER MOVING MOTOR
S83
183
MOTOR DRIVE UNIT
74a
MOTOR FOR SIDE JOGGER
74b
MOTOR FOR SIDE JOGGER
S15
115
HP SENSOR FOR PRESS ROLLERS
S84
184
MOTOR DRIVE UNIT
814
PRESS ROLLER MOVING MOTOR
S85
185
MOTOR DRIVE UNIT
815
SUPPLY ROLLER ROTATING MOTOR
S93
HP DETECTION SENSOR
93
S21
821
HP SENSOR FOR CLAMPING
S94
UPPER END DETECTION SENSOR
94

PAPER SHEET HANDLING DEVICE

This is a national stage application filed under 35 USC 371 based on International Application No. PCT/JP2007/074985 filed Dec. 26, 2007, and claims priority under 35 USC 119 of Japanese Patent Application No. 2006-352012 filed Dec. 27, 2007 and Japanese Patent Application No. 2006-352013 filed Dec. 27, 2007.

TECHNICAL FIELD

This invention relates to a paper-sheet handling device that is preferably applied to an apparatus which performs a punching process, a binding process or the like on recording paper-sheets released from a copy machine, a print machine or the like for black-and-white use or color use. Particularly, it relates to one in which a clamp-opening-and-closing driving section that drives a movable clamp member is provided with a cam, a part of the cam having a given shape defines a normal operation range thereof, and a hollowed part thereof, which is continuous with this part having the given shape, defines a lock position for opening the clamp so that a roller member of the movable clamp member or the like can drop into the hollowed part thereof, and it is possible to carry out any jam-removing operation with the movable clamp member being opened when an error occurs.

BACKGROUND ART

In recent years, a case in which a copy machine, a print machine or the like for black-and-white use and for color use is used by combining a paper-sheet handling device that performs a punching process, a binding process or the like has been increased. According to this kind of paper-sheet handling device, as referred to page 2 and FIG. 4 of Japanese Patent Application Publication No. 2003-320780, the paper-sheets after the image is formed are received and are perforated by utilizing a punching function provided on a downstream side of the paper-sheets. The paper-sheets after the perforation are aligned. A binding component is automatically inserted into the punch holes thus perforated of the aligned paper-sheets.

By the way, it is configured that the paper-sheet handling device is provided with a paper-sheet-reserving unit in which, when aligning a plurality of paper-sheets after the perforation, the paper-sheets are temporarily reserved. The paper-sheet-reserving unit is provided with an alignment pin driving mechanism and in the paper-sheet-reserving unit unit, a plurality of paper-sheets entered from a paper-sheet transport path is stacked up with them being aligned. The stacked paper-sheets are aligned with an end surface and a forward end of the each paper-sheet being adjusted with their reference positions. When paper-sheets are stacked by one volume, alignment pins are inserted into two predetermined punch holes in a bundle of paper-sheets so that rearrangement (pre-alignment) is performed thereon based on the positions of punch holes. It is configured that the bundle of rearranged paper-sheets is moved to the binding processing unit while it is sandwiched by a clamp movement mechanism. In the binding processing unit, any ring binding process is performed by a binding component under the condition where the bundle of paper-sheets is aligned. According to the conventional paper-sheet handling device, however, there are problems as follows.

i. A paper-sheet handling device disclosed in Page 2 and FIG. 4 of Japanese Patent Application Publication No. 2003-320780 is provided with a clamp movement mechanism and the clamp movement mechanism holding the bundle of paper-sheets is often moved toward a binding processing unit parallel to it. If during this movement, a center position of the bundle of paper-sheets alters based on a thickness thereof, it is impossible to guide the center position of the bundle of paper-sheets to a ring center position of the binding processing unit with a good reproducibility, thereby resulting in a problem such that a poor binding by the binding member occurs.

ii. Accordingly, when the bundle of paper-sheets is moved from the paper-sheet-reserving unit to the binding processing unit while the center position alters on the basis of the thickness of the bundle of paper-sheets, the bundle of paper-sheets bends between a running guide and a clamper, thereby causing the bundle of paper-sheets to be scratched or the paper-sheets to be deviated from each other.

iii. If the poor binding by the binding member as described above occurs, any jam-removing operation must be performed in the paper-sheet-reserving unit under a condition where an excitation in a motor of the clamp-opening-and-closing driving section is turned off and a booklet is sandwiched in the clamp mechanism section. This causes the removing operation to be performed with a manipulation lever for opening the clamp being turned, thereby resulting in a problem of a poor operability on a jam processing.

iv. The above-mentioned paper-sheet handling device is provided with a clamp movement mechanism, which is often moved to the binding processing unit while it holds the bundle of paper-sheets. In this case, since the clamp movement mechanism is configured so that the clamp mechanism section and the clamp-opening-and-closing driving section are mounted on a main board, the clamp movement mechanism must be moved to the binding processing unit by the main board on which the clamp mechanism section and the clamp-opening-and-closing driving section are mounted if the clamp mechanism section holds the bundle of aligned paper-sheets.

v. Incidentally, if a structure such that the whole of clamp movement mechanism is moved to the binding processing unit is taken, a structure of the clamp movement mechanism (hereinafter referred to as "paper-sheet fixation and movement mechanism") is not only made complex but harness (wiring) processing for supplying a power source to the clamp-opening-and-closing driving section is also made complex, thereby resulting in a problem such that it causes the paper-sheet handling device to be hindered from being made inexpensive.

DISCLOSURE OF THE INVENTION

A first paper-sheet handling device according to the present invention is a paper-sheet handling device that transports a bundle of paper-sheets obtained by binding a plurality of paper-sheets, characterized in that the device is provided with a paper-sheet fixation and movement mechanism that contains a fixed clamp member and a movable clamp member and transports the bundle of paper-sheets with it being fixed, wherein the paper-sheet fixation and movement mechanism contains a clamp-opening-and-closing driving section that drives the movable clamp member, wherein the clamp-opening-and-closing driving section is provided with a cam, and wherein the cam contains a part having a given shape, the part defining a normal operation range in which the movable clamp member is moved up to a predetermined position with respect to the fixed clamp member to release the bundle of paper-sheets, and a hollowed part that keeps a lock position for opening the clamp, the hollowed part being continuous with the part having the given shape.

According to the first paper-sheet handling device relating to the present invention, when transporting the bundle of paper-sheets obtained by binding the plurality of paper-sheets, the paper-sheet fixation and movement mechanism transports the bundle of paper-sheets with it being fixed together with the fixed clamp member and the movable clamp member. On the assumption of this, the clamp-opening-and-closing driving section drives the movable clamp member. The clamp-opening-and-closing driving section is provided with a cam and, when releasing the bundle of paper-sheets, the cam moves the movable clamp member up to a predetermined position with respect to the fixed clamp member by a part thereof having a given shape, which defines a normal operation range, to release the bundle of paper-sheets. Further, when an error or the like occurs, by rotating the cam to a hollowed part that is continuous with the part having the given shape, the roller member or the like of the movable clamp member can drop into the hollowed part. Accordingly, it becomes possible to lock the opened situation of the movable clamp member. This enables the operability to be improved because any jam-removing operation is carried out with the movable clamp being opened. Furthermore, since the lock position for opening the clamp is set to a position that is different from the normal operation range, it is possible to prevent release of the lock of the manipulation lever from being forgotten.

A second paper-sheet handling device according to the present invention is a paper-sheet handling device that transports a bundle of paper-sheets obtained by binding a plurality of paper-sheets, characterized in that the device is provided with a paper-sheet fixation and movement mechanism that contains a fixed clamp member and a movable clamp member, respectively, at a right end side and a left end side and transports the bundle of paper-sheets with it being fixed, wherein the paper-sheet fixation and movement mechanism contains a main body member, a clamp-opening-and-closing driving section that drives the movable clamp members at the right and left end sides, the clamp-opening-and-closing driving section being attached to the main body member, and a paper-sheet fixation and movement section that is movably attached to the main body member and transports the bundle of paper-sheets with it being fixed separately from the clamp-opening-and-closing driving section.

According to the second paper-sheet handling device relating to the present invention, when transporting the bundle of paper-sheets obtained by binding the plurality of paper-sheets, the paper-sheet fixation and movement mechanism contains the fixed clamp member and the movable clamp member at a right end side and a left end side, respectively and transports the bundle of paper-sheets with it being fixed therewith. For example, in the paper-sheet fixation and movement mechanism, the paper-sheet fixation and movement section is movably attached to the main body member. It is configured that the paper-sheet fixation and movement section contains an urging member and urges the respective movable clamp members to a side of the fixed clamp members to keep a clamp-closed situation.

The clamp-opening-and-closing driving section is attached to the main body member to drive the movable clamp members at the right and left end sides. For example, the clamp-opening-and-closing driving section exceeds urging force of the paper-sheet fixation and movement section against the respective movable clamp members to keep the clamp-opened situation. On this situation, a plurality of paper-sheets is bound to obtain the bundle of paper-sheets. It is configured that the paper-sheet fixation and movement section transports the bundle of paper-sheets with it being fixed separately from the clamp-opening-and-closing driving section.

Consequently, when transporting the bundle of paper-sheets, it is possible to separate the clamp-opening-and-closing driving section and the paper-sheet fixation and movement section from each other structurally and to move the bundle of paper-sheets to a binding step or the like easily with it being fixed by means of the paper-sheet fixation and movement section which mounts a necessary minimal level of structural parts. Furthermore, it is possible to make a movement area (a dead space) of the paper-sheet fixation and movement section less and to make the unit structure smaller and simpler. No driving means such as a motor or no electric part such as home position sensor is mounted on the paper-sheet fixation and movement section so that any wiring (harness) processing is unnecessary because movement of such an electric part is not accompanied, thereby allowing the paper-sheet fixation and movement mechanism to be simplified.

BRIEF DESCRIPTION OF DRAWINGS

FIG. 8 is a perspective view showing an operation example of the alignment-pin-driving mechanism 91 before pins pass through.

FIG. 9 is a perspective view showing an operation example of the alignment-pin-driving mechanism 91 when the pins pass through.

FIG. 19 is a block diagram showing a configuration example of a control system of the binder paper alignment unit 30.

BEST MODE OR CARRYING OUT THE INVENTION

Figure 1:
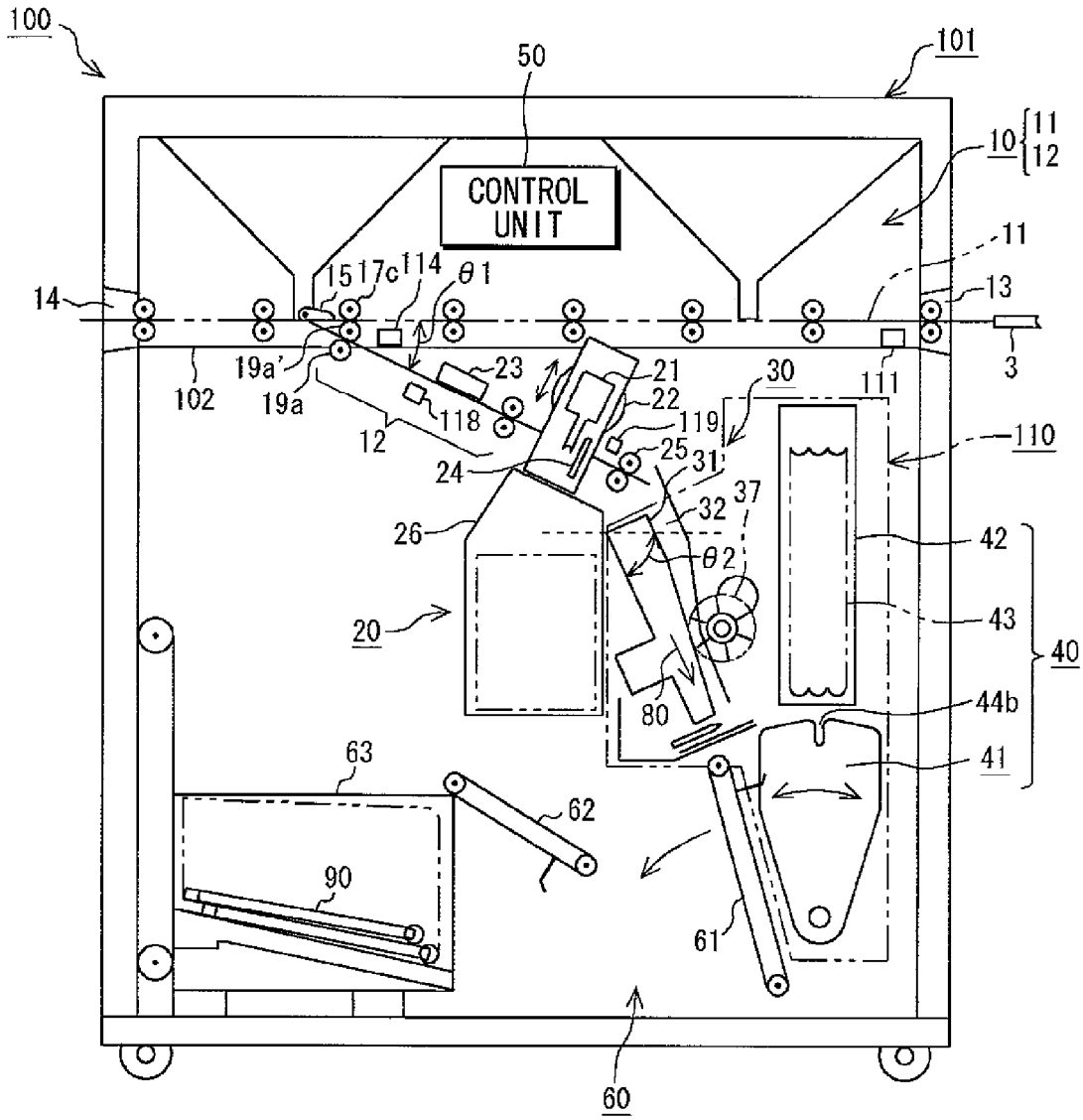
FIG. 1 is a conceptional diagram showing a configuration example of a paper-sheet-handling device 100 to which a paper-sheet handling device as an embodiment according to the present invention is applied.

The present invention has an object to provide a first paper-sheet handling device by which it becomes possible to improve workability and operability when a jam removes and to prevent release of the lock of the manipulation lever from being forgotten. It also has an object to provide a second paper-sheet handling device by which it becomes possible to simplify the structure of the paper-sheet fixation and movement section that moves the bundle of paper-sheets to the binding step with it being fixed.

Hereinafter, the paper-sheet handling devices relating to exemplified embodiments of this invention will be explained with respect to with reference to the drawings. The paper-sheet-handling device 100 shown in FIG. 1 applies a punching process to a recording paper (hereinafter, merely referred to as paper-sheet 3) released from the copy machine or the print machine, aligns positions of the holes respectively perforated at predetermined positions and binds a plurality of paper-sheets 3 to form the bundle of paper-sheets. It is configured that the paper-sheet-handling device 100 then releases the recording paper after the binding process by predetermined binding components (consumables) 43.

The paper-sheet-handling device 100 has a device main body portion (housing) 101. It is preferable for the paper-sheet-handling device 100 to be used in conjunction with a copy machine, a printing machine (picture forming device) or the like, and the device main body portion 101 has a comparable height as that of the copy machine, the printing machine or the like. A paper-sheet transport unit 10 which constitutes one example of paper-sheet transport means is provided in a device main body portion 101. The paper-sheet transport unit 10 has a first transport path 11 and a second transport path 12. The transport path 11 has a paper-feed inlet 13 and an outlet 14, and has a through-pass function for transporting the paper-sheet 3 drawn from the paper-feed inlet 13 toward the outlet 14 that becomes the predetermined position.

Here, the through-pass function means a function such that the transport path 11 positioned between a copy machine, a printing machine or the like on the upstream side and other paper-sheet handling device on the downstream side directly delivers the paper-sheet 3 from the copy machine, the printing machine or the like to the other paper-sheet handling device. In a case in which the through-pass function is selected, it is configured that the acceleration process of the transport rollers, the binding process or the like is omitted. The paper-sheet 3, usually, in case of one-side copy, is delivered in a state of the face down. A paper feed sensor 111 is mounted on the paper-feed inlet 13 so as to output a paper feeding detection signal S11 to a control unit 50 by detecting a front edge of the paper-sheet 3.

The transport path 12 has a switchback function by which the transport path is switchable from the transport path 11. Here, the switchback function means a function that decelerates and stops the transport of the paper-sheet 3 at a predetermined position of the transport path 11, thereafter, switches the transport path of the paper-sheet 3 from the transport path 11 to the transport path 12, and also, delivers the paper-sheet 3 in the reverse direction. A flap 15 is provided in the transport path 11 so as to switch the transport path from the transport path 11 to the transport path 12.

Also, three cooperative transport rollers 17*c*, 19*a*', 19*a* are provided at a switch point between the transport path 11 and the transport path 12. The transport rollers 17*c* and 19*a* rotate clockwise, and the transport roller 19*a*' rotates counterclockwise. For example, it is constituted such that the transport roller 19*a*' is a drive roller and the transport rollers 17*c* and 19*a* are driven rollers. The paper-sheet 3 taken by the transport rollers 17*c* and 19*a*' decelerates and stops, but when it is restricted from the upper side to the lower side by the flap 15, the paper-sheet is fed by the transport rollers 19*a*' and 19*a* so as to be transported to the transport path 12. A paper-sheet detecting sensor 114 is disposed just before the three cooperative transport rollers 17*c*, 19*a*' and 19*a*, and it is configured that a front end and a rear end of the paper-sheet are detected and a paper-sheet detection signal S14 is outputted to the control unit 50.

A punching process unit 20 is arranged on the downstream side of the transport path 12. In this embodiment, it is designed such that a predetermined angle is determined between the transport path 11 and the transport path 12 as above mentioned. For example, a first depression angle θ1 is set between a transport surface of the transport path 11 and a paper-sheet surface to be perforated of the punching process unit 20. Here, the paper-sheet surface to be perforated means a surface where holes are perforated in the paper-sheet 3. The punching process unit 20 is arranged so that the paper-sheet surface to be perforated can be set to a position having the depression angle θ1 on the basis of the transport surface of the transport path 11.

It is configured that in the punching process unit 20, two or more holes for the binding (hereinafter, referred to as "punch holes 3*a*") are perforated at the one end of the paper-sheet 3 which switchbacks from the transport path 11 and transported by the transport path 12. The punching process unit 20 has, for example, a motor 22 that drives a reciprocatingly operable punch blade 21. The paper-sheet 3 is perforated by the punch blade 21 driven by the motor 22 for every sheet.

An openable and closable fence 24 that becomes a reference of the perforation position is provided in the punching process unit 20 and is used so as to attach the paper-sheet 3 thereto. Further, a side jogger 23 is provided in the punching process unit 20 so that the posture of the paper-sheet 3 can be corrected. For example, the front edge of the paper-sheet 3 is made to be attached uniformly to the openable and closable fence 24. The fence 24 becomes a positional reference at the time of aligning the paper-sheet edge portion. A paper-sheet detecting sensor 118 is disposed before the side jogger 23, and it is configured that the front end and the rear end of the paper-sheet are detected and a paper-sheet detection signal S18 is outputted to the control unit 50 (see FIG. 19).

The punching process unit 20 stops the paper-sheet 3 by attaching it to the fence 24 and thereafter, perforates the front edge of the paper-sheet 3. It should be noted that a punch scrap storing unit 26 is provided under the punching process main body so that the punch scrap cut off by the punch blade 21 can be stored therein. A paper output roller 25 is provided on the downstream side of the punching process unit 20 and the paper-sheet 3' after the paper-sheet perforation is made so as to be transported to the unit of the succeeding stage.

In this embodiment, a paper-sheet alignment and binding processing unit 110 as one block is arranged on the downstream side of punching process unit 20. The paper-sheet alignment and binding processing unit 110 has a binder paper alignment unit 30 and it is configured that it aligns positions of the punch holes of a plurality of paper-sheets 3' which are released from the punching process unit 20 so as to be reserved (stored) temporarily.

The binder paper alignment unit 30 is arranged so as to set the paper-sheet-reserving unit surface at the position having a second depression angle θ2 by making a transport surface of a transport path 11 to be a reference. Here, the paper-sheet-reserving unit surface means a surface that reserves (stacks) the paper-sheets 3' where the punch holes 3*a* are perforated. In this embodiment, a relation between the depression angle θ1 and the depression angle θ2 is set as $\theta 1<\theta 2$. With respect to the depression angle θ1, it is set as $0°<\theta 1<45°$ and with respect to the depression angle θ2, it is set as $0°<\theta 2<90°$ respectively. This is set for reducing a width of the device main body portion 101 and for linearly transporting the paper-sheets 3' under this condition (see FIG. 2).

A releasing unit 60 is arranged on the downstream side of the paper-sheet alignment and binding processing unit 110, and it is configured that a releasing process for a booklet 90 produced by the binding process unit 40 is carried out. The releasing unit 60 is constituted so as to include, for example, a first belt unit 61, a second belt unit 62 and a stacker 63.

It is configured that the belt unit 61 receives the booklet 90 that is dropping from the binder paper alignment unit 30, and switches the delivery direction. For example, it is configured that the belt unit main body is turned around toward a predetermined release direction from the position from which the paper-sheet transporting direction of the binder paper alignment unit 30 can be looked over. It is configured that the belt unit 62 receives the booklet 90 whose delivery direction is switched by the belt unit 61 and transports it in the relay manner. It is also configured that the stacker 63 accumulates the booklets 90 transported by the belt units 61 and 62.

Figure 2:
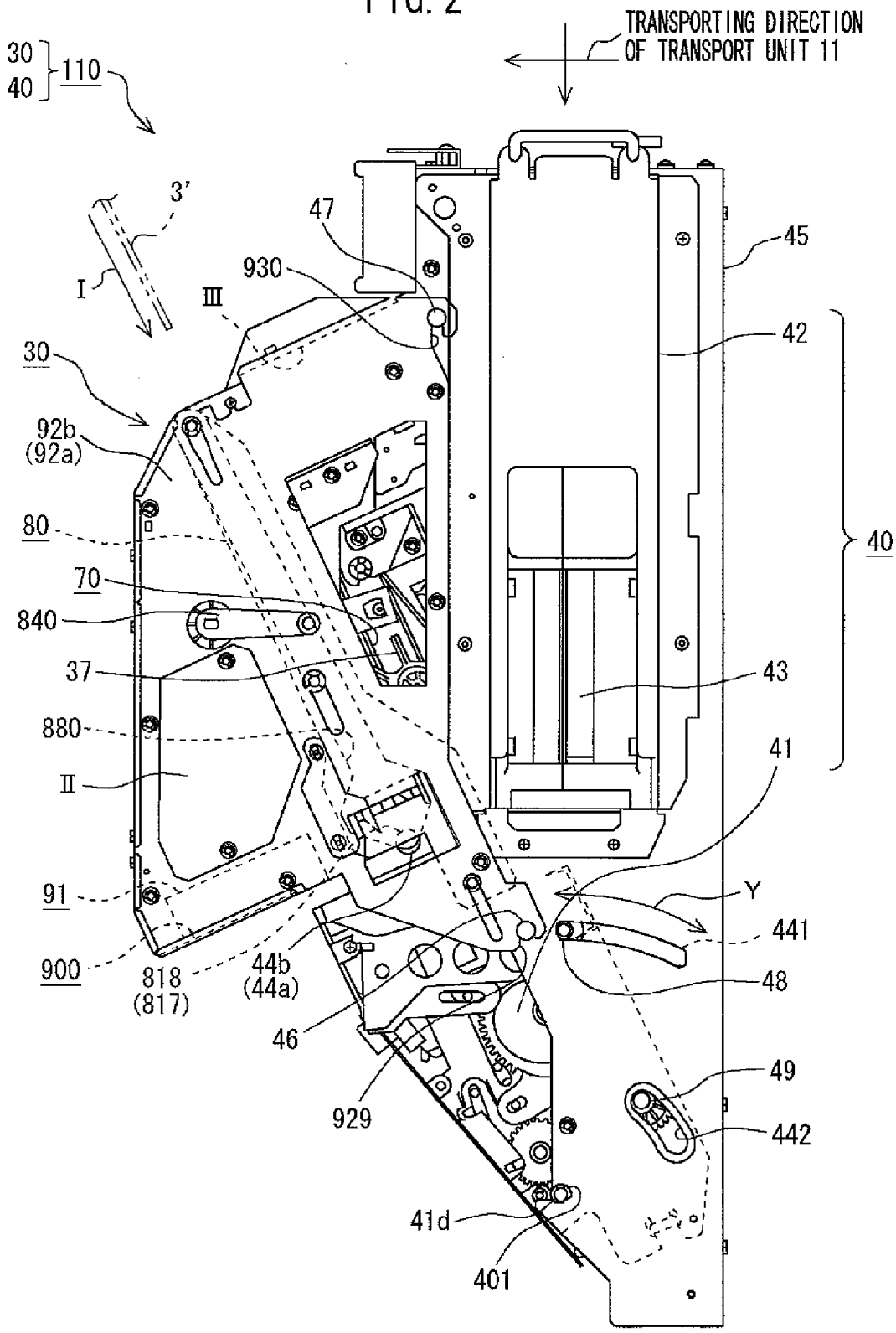
FIG. 2 is front diagram showing a configuration example of a paper-sheet alignment and binding processing unit 110.

The following will describe a configuration example of the paper-sheet alignment and binding processing unit 110 with reference to FIG. 2. The paper-sheet alignment and binding processing unit 110 shown in FIG. 2 is mounted on the paper-sheet-handling device 100 shown in FIG. 1 and is configured so as to have a chassis 45 for mounting the binding process unit other than the binder paper alignment unit 30. The chassis 45 has a predetermined shape shown in FIG. 2 and is configured so as to support the binder paper alignment unit 30 and the binding process unit 40. For example, it is configured so as to have a housing shape such that in FIG. 2, an upper portion of the left end side of the chassis 45 is closed, a lower portion thereof is opened, a front surface thereof is provided with a binder cassette mounting area, and the right end side and the back surface side thereof are closed.

It is configured that a projected engaged portion 46 is provided at a lower portion and an engaged portion 47 is provided at an upper portion, at predetermined positions of the front surface of the chassis 45 as well as a projected engaged portion 46 and an engaged portion 47, not shown, are also provided at predetermined positions of the back surface thereof, thereby supporting the binder paper alignment unit 30 on a left side surface of the chassis 45.

Figure 7:
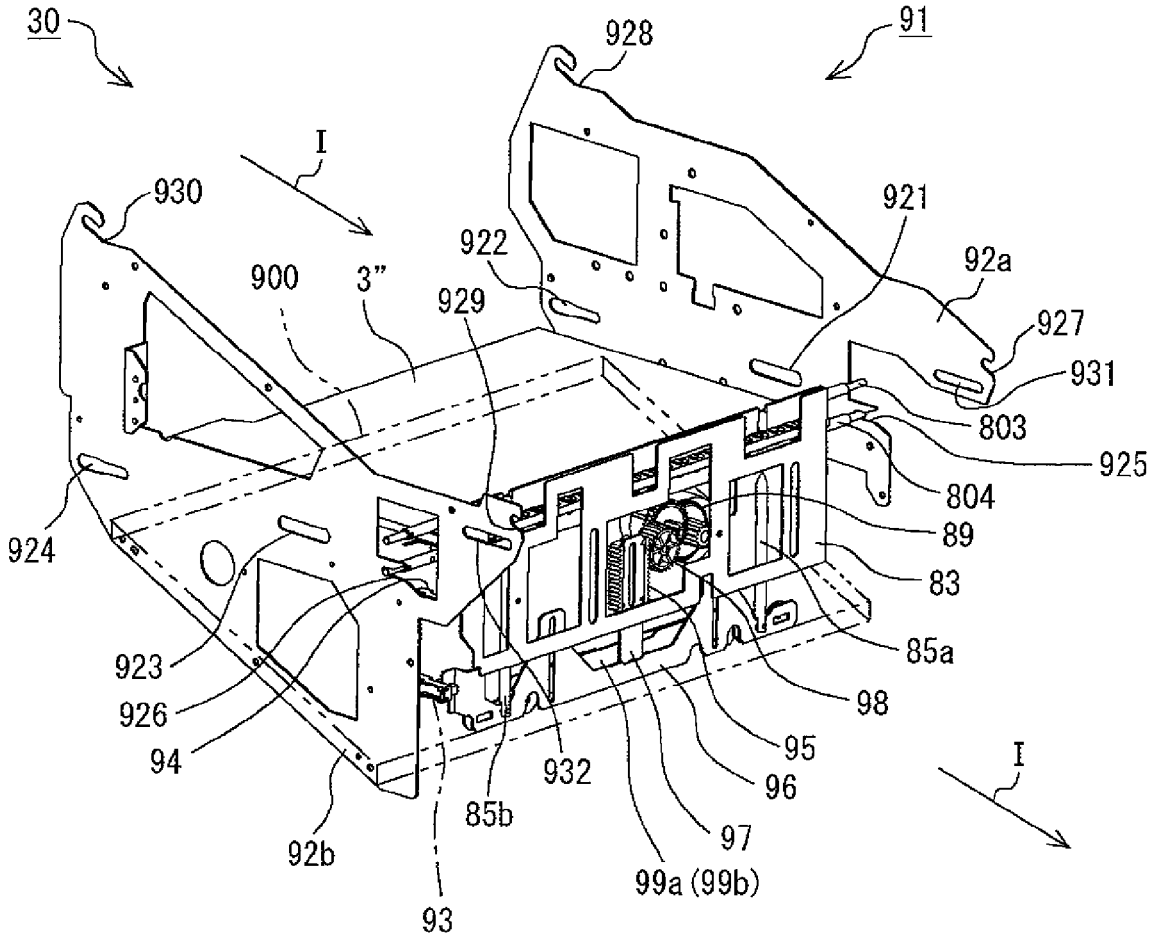
FIG. 7 is a perspective view showing a configuration example of an alignment-pin-driving mechanism 91.

The binder paper alignment unit 30 has a main body board 900 and is provided with a right end frame 92*a* and a light end frame 92*b*, each of which are formed as parallelogram, at both side surfaces of the main body board (see FIG. 7). The light end frame 92*b* is provided with a groove 929 for engaging the lower portion thereof, which has, for example, a U-shape and similarly, is provided with a groove 930 for engaging the upper portion thereof. The groove 929 for engaging the lower portion is caught by the projected engaged portion 46 of the chassis 45 and the groove 930 for engaging the upper portion is also caught by the projected engaged portion 47, respectively, so that they are fixed, thereby enabling the binder paper alignment unit 30 and the binding process unit 40 to be united.

It is configured so that in the binder paper alignment unit 30, parts-mounting areas II and III that mount various kinds of configuration parts are defined within an area surrounded by the right end frame 92*a*, the left end frame 92*b* and the main body board 900. In this embodiment, the clamp movement mechanism 80 which constitutes an example of the paper-sheet fixation and movement mechanism is arranged on a boundary defining the parts-mounting areas II and III, a diagonal line of the parallelogram in the left end frame 92*b* in this embodiment. The clamp movement mechanism 80 is configured so as to move the bundle of paper-sheets 3" stacked by the perforated paper-sheets 3' to a paper-sheet transport direction with it being held by the clamp members.

In the parts-mounting region III of right side with reference to the attached position of this clamp movement mechanism 80, a paper-sheet curl pressing mechanism 31 and a paddle roller 37 are arranged. The paper-sheet curl pressing mechanism 31 is arranged near a paper-sheet-proceeding port in the unit 30 and is configured so as to guide the paper-sheet 3' to a predetermined position (in the paper-sheet-reserving unit 32 or the like) of the binder paper alignment unit 30 when the paper proceeds and to press a rear end side of the paper-sheet 3' when the paper finishes proceeding. The binder paper alignment unit 30 has a width-alignment function of the front edge and corner portion of the paper-sheet. In this embodiment, a multiple-paddle shaped rotating member (hereinafter, referred to as a paddle roller 37) is provided in the unit 30 and is configured so as to attach the front edges of the paper-sheets 3' to a reference position when the paper proceeds and to align the side edges thereof for aligning the bundle of paper-sheets. A handle type clamp lever 840 shown in FIG. 2 is used when releasing the clamp (see FIG. 21).

In the parts-mounting region II of left side with reference to the above-mentioned clamp movement mechanism 80, an alignment-pin-driving mechanism 91 is arranged and is configured so as to realign the bundle of paper-sheets by utilizing the punch holes 3*a* perforated in the paper-sheets 3'. The binding process unit 40 is arranged on the downstream side of the above-mentioned alignment-pin-driving mechanism 91 and is configured so as to bind a plurality of paper-sheets 3" that are aligned by the binder paper alignment unit 30 by means of binding component 43 to create a booklet 90. The booklet 90 is referred to as a bundle of paper-sheets 3" which the binding component 43 is fitted to bind.

The binding process unit 40 is constituted by containing a binder cassette 42 in which the binding components 43 are mounted and a movement mechanism 41 for the binding process. The movement mechanism 41 operates so as to perform a reciprocation movement between the transport path of the bundle of paper-sheets in the binder paper alignment unit 30 and a position that is perpendicular to a transporting direction of the above-mentioned transport path 11. The binding process unit 40 contains the binder (binding component) cassette 42. A plurality of binding components is set in the binder cassette 42. Various kinds of the binding components are prepared by, for example, injection molding corresponding to thickness of the bundle of paper-sheets 3".

The movement mechanism 41 for the binding process is also attached to a lower portion of the front surface of the chassis 45. In this embodiment, it is configured that the lower portion of the front surface of the chassis 45 reduces gradually in its width as it goes ahead toward the lower portion. In this portion, long aperture guide portions 441 and 442 each having an arc of a circle and a bearing portion 401 having U-shape are respectively provided.

In this embodiment, a movement mechanism rotating axis 41*d*, a projection portion 48 for guide and a gear axis 49 for limiting the driving shaft are arranged at predetermined positions of the movement mechanism 41. The movement mechanism rotating axis 41*d* is movably engaged with the above-mentioned bearing portion 401, the projection portion 48 is engaged with the long aperture guide portion 441 and the gear axis 49 is movably engaged with the long aperture guide portion 442. When performing the bind processing, the movement mechanism 41 operates with reference to the movement mechanism rotating axis 41*d* along the long aperture guide portions 441, 442 so as to be limited as the arc of the circle indicated by an arrow Y shown in the figure.

On the other hand, the clamp movement mechanism 80 is provided with roller members 817, 818 at both sides of its lower forward end and the movement mechanism 41 is provided with openings 44*a*, 44*b* each having Y-shape at both sides of its upper forward end. In this embodiment, when performing the bind processing on the binding component 43, only a paper-sheet fixation and movement section 880 in the clamp movement mechanism 80 drops by its self weight so that it is configured that the roller member 817 is fitted into the opening 44*a* and the roller member 818 is fitted into the opening 44*b*, with a self-aligning method. Thus, a structure is made such that by fitting the roller members 817, 818 into the openings 44*a*, 44*b*, the movement mechanism 41 is connected on a straight line and a center position of the bundle of paper-sheets 3" is guided to a center position of the binding component 43.

The movement mechanism 41 pulls out one piece of binding components 43 from the binder cassette 42 to hold it and in this state, rotates to a position from which the paper-sheet transporting direction I of the binder paper alignment unit 30 can be looked over. At this position, the movement mechanism 41 receives the bundle of paper-sheets 3" whose punch holes are position-aligned from the binder paper alignment unit 30 and inserts the binding component 43 into the punch holes thereof to execute the binding process (automatic bookmaking function).

The following will describe a paper-sheet handling example with respect to a paper-sheet handling method relating to the invention with reference to process diagrams shown in FIGS. 3A through 3D.

Figure 3:
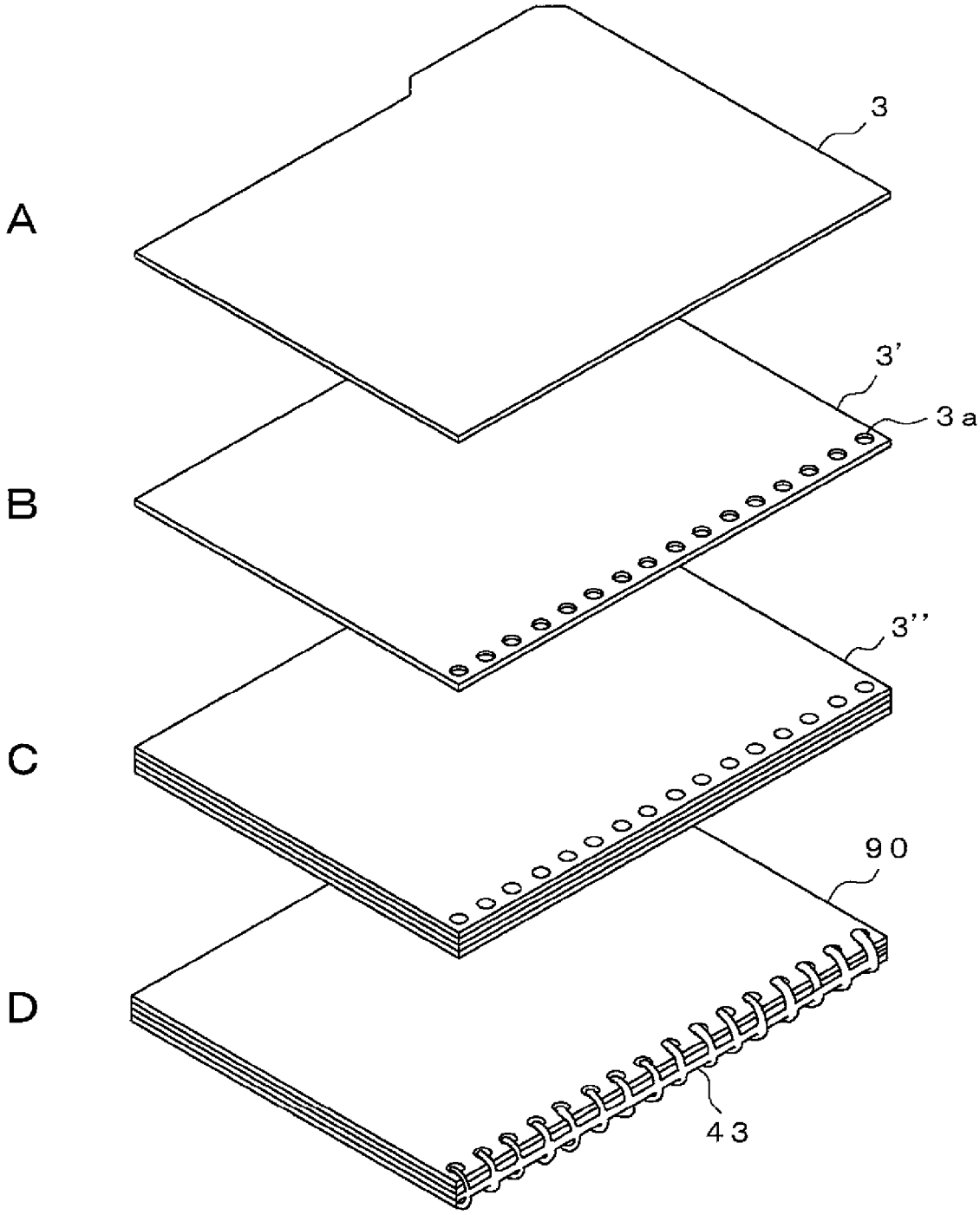
FIGS. 3A through 3D are process diagrams each showing a function example of the paper-sheet-handling device 100.

The paper-sheet 3 shown in FIG. 3A is one which has been fed from the upstream side of the paper-sheet-handling device 100. It is one in which punch holes are not perforated. The paper-sheet 3' is transported and directed to the predetermined position of the transport path 11 shown in FIG. 1 and is decelerated and stopped at the predetermined position of the transport path 11. Thereafter, the transport path of the paper-sheet 3' is switched from the transport path 11 to the transport path 12 and also, the paper-sheet 3' is delivered in the reverse direction and is transported to the punching process unit 20. The transport path 12 is distributed so that it extends from the downstream side of the punching process unit 20 up to the binding process unit 40 along the paper-sheet transporting direction I via the binder paper alignment unit 30. A downstream side of the binder paper alignment unit 30 becomes the transport path for the bundle of paper-sheets.

In the punching process unit 20, as shown in FIG. 3B, a predetermined number of punch holes 3*a* for the binding are perforated at one end of the paper-sheet 3'. The paper-sheet 3' in which the punch holes for the binding are perforated is transported to the binder paper alignment unit 30. It is configured that when the paper-sheets 3' reach a preset quantity thereof to form the bundle of paper-sheets 3" as shown in FIG. 3C, in the binder paper alignment unit 30, the positions of the punch holes 3*a* for the binding are aligned and the binding component 43 is fitted into the punch holes 3*a* thereof under the cooperation of the binding process unit 40. Thus, it is possible to obtain the booklet 90, as shown in FIG. 3D, fitted with the binding component 43.

Figure 4:
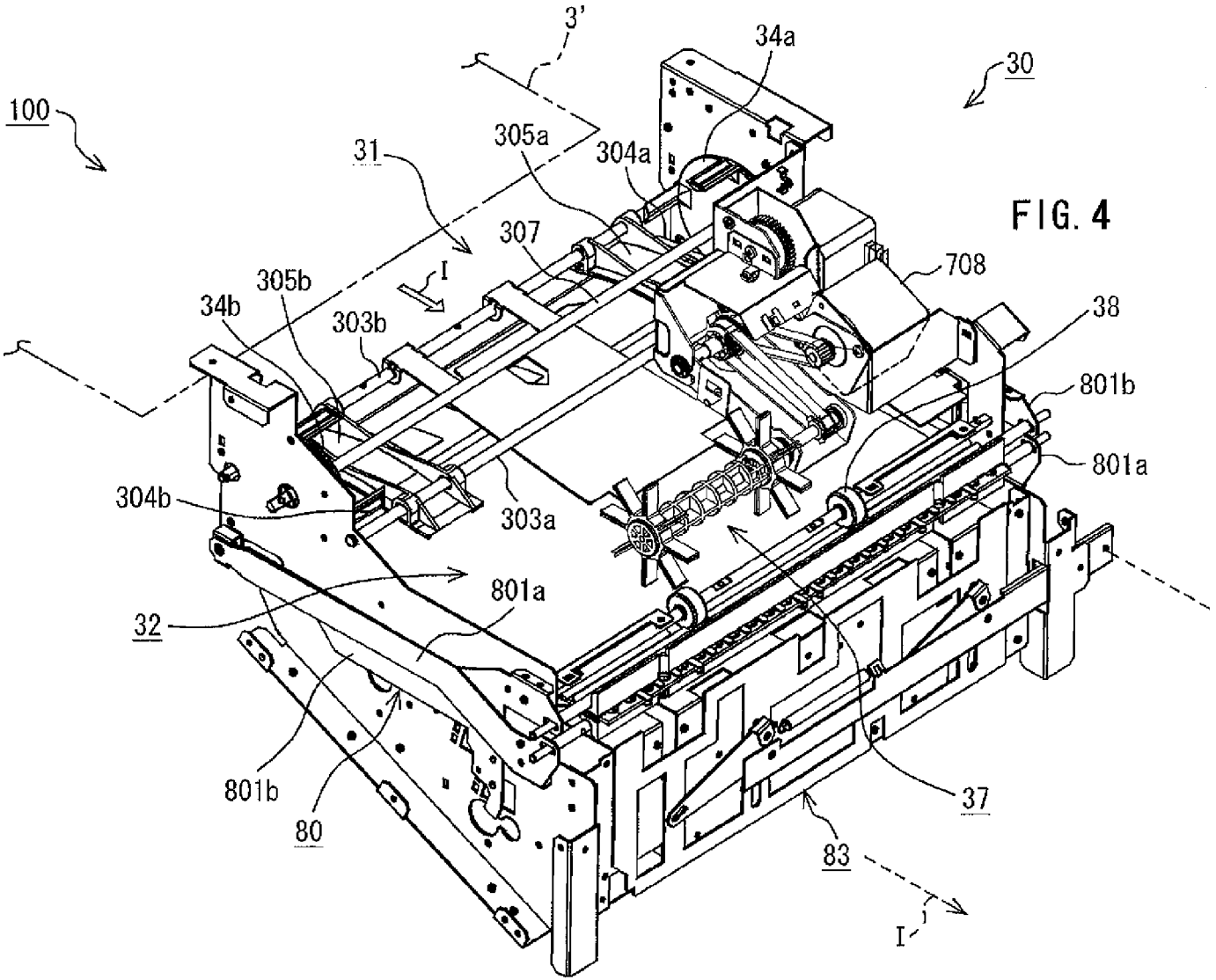
FIG. 4 is a perspective view showing a configuration example of the binder paper alignment unit 30.
Figure 5:
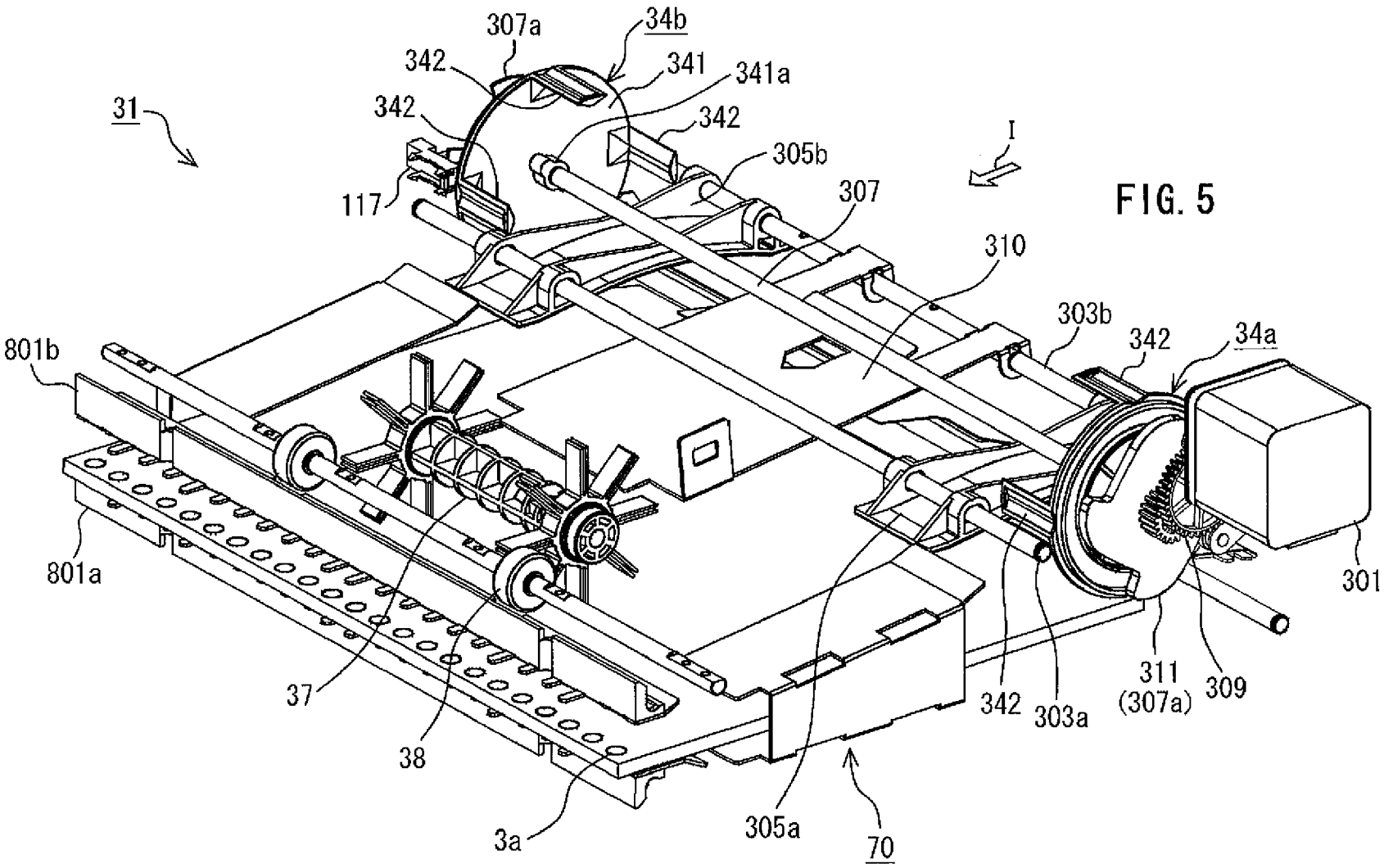
FIG. 5 is a perspective view showing configuration examples of a paper-sheet curl pressing mechanism 31 and a periphery thereof.

The following will describe a configuration example of the paper-sheet curl pressing mechanism 31 and its periphery mechanism with respect to the binder paper alignment unit 30 with reference to FIGS. 4 and 5.

The binder paper alignment unit 30 shown in FIG. 4 shows its situation in which a shutter 83 is opened and is a unit which attaches a plurality of the paper-sheets 3' transported by the paper-sheet transport unit 10 shown in FIG. 1 to the reference position, aligns the positions of the punch holes 3*a* of the bundle of paper-sheets 3" to be stacked and temporarily reserves it. The binder paper alignment unit 30 has a paper-sheet-reserving unit 32. The binder paper alignment unit 30 has a paper-sheet curl pressing mechanism 31 near the paper-proceeding port.

It is configured that the paper-sheet curl pressing mechanism 31 guides the paper-sheet 3' to the paper-sheet-reserving unit 32 when the paper proceeds and presses a rear end side of the paper-sheet 3' when the paper finishes proceeding. The paper-sheet-reserving unit 32 stacks the paper-sheets 3' and temporarily reserves them.

The shutter 83 is arranged near a paper-sheet-taking-out port of the paper-sheet-reserving unit 32 and shuts the transport of the paper-sheets 3' to the paper-sheet transporting direction I when aligning the bundle of paper-sheets. Inside of the shutter 83 (at a side of the paper-sheet-reserving unit 32), a clamp member constituted of a movable upper arm 801*b* and a fixed lower arm 801*a* in the clamp movement mechanism 80 is opened and the paper-sheets 3' are bound under this condition. When taking out the paper-sheets, the shutter 83 is opened and they are transported to a next step with the bundle of paper-sheets being clamped by the upper arm 801*b* and the lower arm 801*a*.

The paper-sheet curl pressing mechanism 31 shown in FIG. 5 is one taken out of the binder paper alignment unit 30 shown in FIG. 4 and is provided with curl fence portions 34*a*, 34*b*, rear guide portions (introduction guides) 304*a*, 304*b* (see FIG. 4) and curl guide portions (running guides) 305*a*, 305*b*.

The curl fence portions 34*a*, 34*b* are arranged at light and left near the paper-taking-out port of the paper-sheet-reserving unit 32. The curl fence portions 34*a*, 34*b* press the rear end side of the paper-sheet 3' guided by the rear guide portions 304*a*, 304*b* and the curl guide portions 305*a*, 305*b* and operate to receive a forward end portion of a next paper-sheet 3'.

The light and left curl fence portions 34*a*, 34*b* are attached on a power transmission shaft (curl fence shaft) 307. A motor 301 is attached to an end of the power transmission shaft 307 through a reduction gear 309. The motor 301 constitutes an example of driving portion and rotates the curl fence portions 34*a*, 34*b* around a predetermined direction.

The curl fence portion 34*a* is constituted by including a disk-like rotation main body 341 and plural projections 342. The rotation main body 341 has an axis 341*a*. To the axis 341*a*, the power transmission shaft 307 is attached. On a circumferential portion of the rotation main body 341, for example, four projections 342 are arranged on every 90 degrees. Each of the projections 342 has a shape projecting toward a direction parallel to the axis 341*a*. Configuring the curl fence portion 34*a* as this enables curled paper-sheet 3' to be pressed by any of the projections 342 during a period of paper-aligning-and-temporarily-reserving time.

For example, by rotating the projections 342 upwards for every time when the paper-sheet proceeds, it is possible to keep a condition in which a curled portion of the paper-sheets 3' stacked is pressed. It is to be noted that the curl fence portion 34*b* is configured and functioned similar to the curl fence portion 34*a* with reference to a structure and a function thereof, thereby omitting the explanation thereof.

The rear guide portions 304*a*, 304*b* are arranged near the light and left curl fence portions 34*a*, 34*b* (see FIG. 4). It is configured that the rear guide portions 304*a*, 304*b* guide to a predetermined direction the forward end portion of the paper-sheet 3' that proceeds to the binder paper alignment unit 30.

Each of the above-mentioned rear guide portions 304*a*, 304*b* has a movable structure so as to have a paddle-like projection, not shown. Such a movable structure enables the paper-sheet 3' to be guided up to a position just near any of the projections 342 and enables it to be prevented from being smashed against the projection 342 even if the curled paper-sheet 3' proceeds, thereby allowing any jam based on this smash to be prevented.

The curl guide portions 305*a*, 305*b* are arranged under the power transmission shaft 307 that connects the above-mentioned curl fence portions 34*a*, 34*b* (see FIG. 4). It is configured that the curl guide portions 305*a*, 305*b* guide the paper-sheet 3' guided by the rear guide portions 304*a*, 304*b* to the paper-sheet-reserving unit 32. Each of the curl guide portions 305*a*, 305*b* has a structure such that they are fixed to positions away from a paper-sheet alignment surface of the paper-sheet-reserving unit 32. For example, the curl guide portions 305*a*, 305*b* are fixed to a pair of guide-supporting rods 303*a*, 303*b* that are built across the paper-sheet proceeding port.

It is configured that an upper guide 310 is attached to the guide-supporting rod 303*b* and guides the paper-sheet 3' to the paper-sheet-reserving unit 32 with holding its rear end portion. The curl guide portions 305*a*, 305*b* are made by, for example, injection molding of resin and is provided with a bottom portion having R-surface with an arc of a circle. Of course, the curl guide portions 305*a*, 305*b* made of metal plate may be used. The size of each thereof is 20 mm to 30 mm in width and around 60 mm to 80 mm in length. The thickness thereof is around 8 mm to 10 mm. Such a configuration enables, when the curled paper-sheet 3' proceeds, any force lifting this paper-sheet to be reduced, thereby allowing any jam because the curled paper-sheet 3' proceeds to be prevented.

The above-mentioned rear guide portion 304*a* is engaged with a cam 311 that is linked with the curl fence portion 34*a*. When the paper-sheet finishes proceeding, it is configured so as to be retracted (waited) from a rotation locus of the curl fence portion 34a by means of the driving of the cam 311. It is configured that for example, the cam 311 of the rear guide portion 304*a* is connected by a follower, which rotates together with the rotation of the curl fence portion 34*a*. Such a configuration allows the rear guide portion 304a to rotate at the same time when the curl fence portion 34*a* rotates and to be retracted from a rotation locus of the curl fence portion 34*a* when the paper-sheet finishes proceeding, thereby enabling it to be prevented from being interfered with the projection.

Further, the rear guide portion 304*a* is configured so as to be rotatable so that a position closely near the projection 342 can be even configured as a guide, which enables any jam to be prevented. It is to be noted that relating to the cam 311 and the follower, the curl fence portion 34*b* is configured and operated similar to the curl fence portion 34*a*, thereby omitting the explanation thereof.

To the other end of the above-mentioned power transmission shaft 307, a disk 307*a* having a predetermined shape (in this embodiment, quatrefoil like one) is mounted, which is used for detecting a home position of the curl fence. A sensor for detecting the home position of the curl fence (hereinafter, referred to as "HP sensor 117") is mounted at a position which is concerned with this disk 307*a*. It is configured that the HP sensor 117 detects a stop position of the curl fence portions 34*a*, 34*b* which are rotated by the motor 301. As the HP sensor 117, an optical sensor (a light-emitting-and-receiving device) of transmission type is used.

Inside the paper-sheet-taking-out port of the paper-sheet-reserving unit 32, which is shown in FIG. 4, a side jogger 70 (width-aligning mechanism) as shown in FIG. 5 is provided, so that it is configured that when aligning the bundle of paper-sheets, the bundle of paper-sheets 3" is pressed by the width-aligning member from one side thereof to align the width of the paper-sheets 3' (first pre-alignment process). The first pre-alignment process is a paper-sheet end alignment process by aligning the side ends of the paper-sheets 3'.

In this embodiment, it is configured that on the downstream side of the side jogger 70, that is, near the paper-sheet-taking-out port in the unit body, an alignment-pin-driving mechanism 91 (see FIG. 7) is mounted and realigns the bundle of paper-sheets 3" by utilizing the punched holes 3a perforated in the paper-sheet 3' (second pre-alignment process). The second alignment process is a paper-sheet front edge alignment process by re-aligning the front edges of the paper-sheets 3'. It is configured that when taking out paper-sheets, the width-aligning members of the side jogger 70 retract to both sides of the bundle of the paper-sheets 3". This is done so in order to give any room to the transport of the bundle of paper-sheets 3" to a paper-sheet transporting direction I.

Inside the paper-sheet outlet in paper-sheet-reserving unit 32, besides the side jogger 70, a supply roller 33 (not shown) and press rollers 38 are disposed (see FIG. 4) so that the bundle of paper-sheets 3" may be pressed from the upper and lower sides respectively when the bundle of paper-sheets 3" is discharged to the next step.

At the paper-sheet-taking-out port, the shutter 83 is provided, which operates to open and close the transport path, not shown, of the bundle of paper-sheets 3" to the paper-sheet transporting direction I. For example, it is configured that if the shutter 83 is opened, with the above-mentioned supply roller 33 and press rollers 38, the bundle of paper-sheets 3" is transported (discharged) along the paper-sheet transporting direction I. By thus configuring the rollers for taking out paper-sheets, even in a case where the bundle of paper-sheets 3" is not bound with the binding component 43, it is possible to transport the bundle of paper-sheets 3" to the next step in a condition where they are kept as a bundle.

Figure 6:
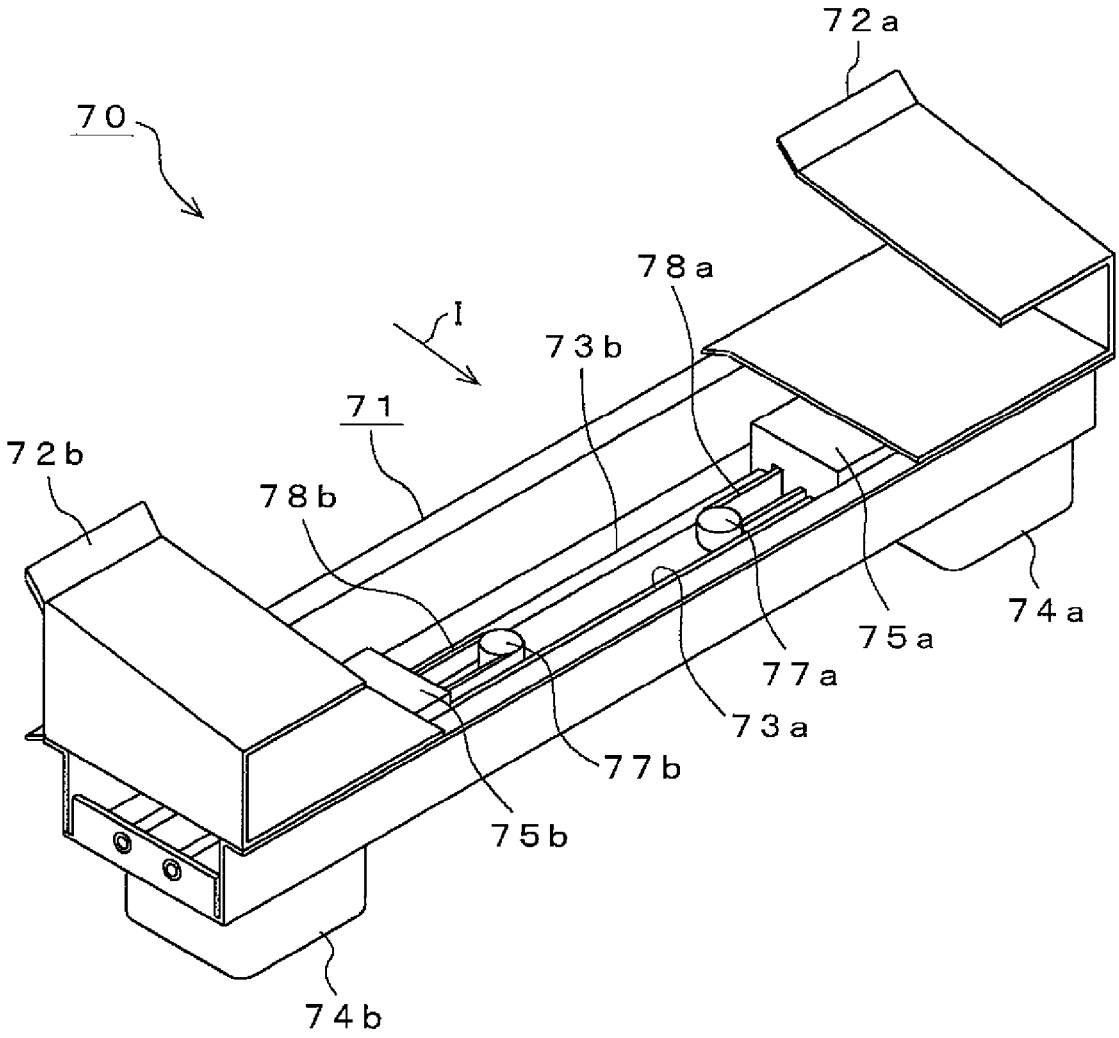
FIG. 6 is a perspective view showing a configuration example of a side jogger 70.

The following will describe a configuration example of the side jogger 70 in the binder paper alignment unit 30 with reference to FIG. 6. In this embodiment, the side jogger 70 is configured so that a width-aligning reference guide 72*b* which provides an end surface reference for the paper-sheet 3' and a width-aligning guide 72*a* which presses each of the paper-sheets 3' against the width-aligning reference guide 72*b* are disposed in a condition where they may face each other in a paper-sheet width direction, and the width-aligning guide 72*a* and the width-aligning reference guide 72*b* may be driven independently of each other. It is configured that, for example, the side jogger 70 aligns the paper-sheets 3' by pressing each of them against the reference side. It is thus possible to align the widths of the paper-sheets 3' temporarily reserved in the binder paper alignment unit 30.

The side jogger 70 shown in FIG. 6 is equipped in the binder paper alignment unit 30 shown in FIG. 4. The side jogger 70 is configured to have a main body housing portion 71, the width-aligning guide 72*a*, the width-aligning reference guide 72*b*, rails 73*a* and 73*b*, motors 74*a* and 74*b*, and movable stages 75*a* and 75*b*.

The main body housing portion 71 is configured to have an upper surface site and a back surface site. The main body housing portion 71 is formed into a box-like body by folding back an iron plate. The upper surface site of the box-like body is open. In this embodiment, the back surface site of the main body housing portion 71 is arranged to be regions where the motors are to be installed. Its upper surface site is arranged to be a region for the movable stages.

In the region for the movable stages, the width-aligning guide 72*a*, the width-aligning reference guide 72*b*, the rails 73*a* and 73*b*, and the movable stages 75*a* and 75*b* are disposed. For example, the rails 73*a* and 73*b* are disposed in such a manner as to bridge the two wall surfaces inside the main body housing portion 71. The rails 73*a* and 73*b* are mounted so that two round rods are attached to positions going through the right-side end and the left-side end of the main body housing portion 71 respectively. With the rails 73*a* and 73*b*, a couple of movable stages 75*a* and 75*b* is engaged in such a manner that they can be moved in the right-and-left direction.

The movable stages 75*a* and 75*b* are made of, for example, molded resin and the movable stages 75*a* and 75*b* have openings (not shown) that are formed therein in such a manner as to pass through in the right-and-left direction, so that through these openings, the rails 73*a* and 73*b* may pass. Of course, the rails 73*a* and 73*b* are not limited to an aspect that they may pass through the openings but may be of such an aspect that the movable stages 75*a* and 75*b* may be fitted with drive wheels so as to travel on the rails 73*a* and 73*b*.

The movable stage 75*b* is fitted with the width-aligning reference guide 72*b* at its upper left end, while the movable stage 75*a* is fitted with the width-aligning guide 72*a* at its upper right end. As the width-aligning guide 72*a* and the width-aligning reference guide 72*b*, for example, an iron plate which is folded back into a deformed U-shape and treated may be used. The width-aligning guide 72*a* and the width-aligning reference guide 72*b* are formed in such a manner that they may become larger on the upstream side and smaller on the downstream side in width. This is done so in order to guide the curled paper-sheet 3' up to the forward end of the paper-sheet-reserving unit 32 with a good reproducibility.

The upstream sides of the width-aligning guide 72*a* and the width-aligning reference guide 72*b* have shapes (flaps) whose upper end portion is jumped up and the lower end portions thereof have shapes which droop oppositely in order to guide paper. These shapes are formed to guide the paper-sheet 3' sent over from the punching process unit 20 to the clamp movement mechanism 80 together with the paddle roller 37.

Further, in the motor installing regions arranged on the back surface site of the main body housing unit 71, the motors 74*a* and 74*b* are installed. As the motors 74*a* and 74*b*, a stepping motor may be used respectively. The motors 74*a* and 74*b* are arranged so that their motor rotary shafts may pass from the back surface site of the main body housing unit 71 through the upper surface site thereof.

In this embodiment, on the side of the upper surface site of the man body housing portion 71, driven pulleys 77*a* and 77*b* are mounted. Between the belt driving pulley 76*a* and the driven pulley 77*a*, a non-terminal belt 78*a* is engaged. Similarly, between the belt driving pulley 76*b* and the driven pulley 77*b*, a non-terminal belt 78*b* is engaged.

Such a configuration can be given that by engaging portions of the belts 78*a* and 78*b* with the movable stages 75*a* and 75*b* so as to enable belt-driving the movable stages 75*a* and 75*b* respectively, the width-aligning guide 72*a* and the width-aligning reference guide 72*b* can be moved in a direction perpendicular to the paper-sheet transport direction.

The following will describe a configuration example of the alignment-pin-driving mechanism 91 with reference to FIG. 7. The alignment-pin-driving mechanism 91 shown in FIG. 7 is shown as being extracted from the binder paper alignment unit 30 shown in FIG. 4, to realign the bundle of paper-sheets 3" having the punched holes 3*a* with respect to these punched holes 3*a*. The bundle of paper-sheets 3" shown in FIG. 7 stays in a condition where it is clamped by the clamp movement mechanism 80 via an upper shaft 803 and a lower shaft 804 before the pin alignment.

The alignment-pin-driving mechanism 91 is equipped to a main body board 900, which provides a base for the binder paper alignment unit 30 and a base for the clamp movement mechanism 80, and configured to have the alignment pins 85*a* and 85*b*, a motor 89, an alignment pin home position sensor (hereinafter referred to as an "HP detection sensor 93"), and an alignment pin upper end detection sensor (hereinafter referred to as an "upper end detection sensor 94").

Figure 10:
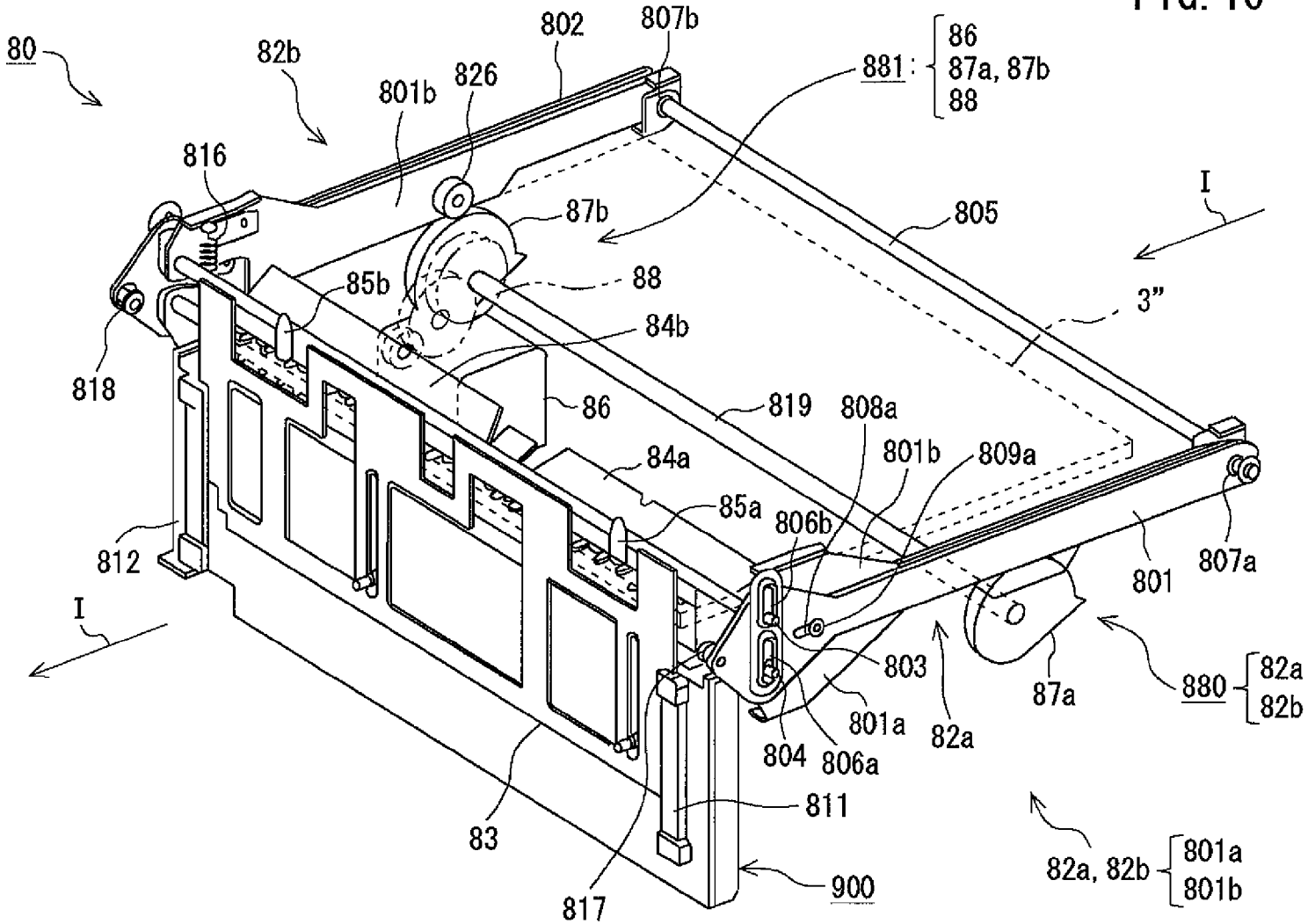
FIG. 10 is a perspective view showing a configuration example of a clamp movement mechanism 80 as a first embodiment.

The main body board 900 is provided with a right edge frame 92*a* (right edge side surface frame) and a left edge frame 92*b* (left edge side surface frame) having predetermined shapes on both sides thereof respectively. In this embodiment, the right edge frame 92*a* has two sliding grooves 921 and 922, while the left edge frame 92*b* has two sliding grooves 923 and 924. To these sliding grooves 921 to 924, the paper-sheet fixation and movement section 880 shown in FIG. 10 is attached so that it can be moved in the paper-sheet transport direction I. It is configured that the paper-sheet fixation and movement section 880 is moved toward a downstream side independently of the main body board 900 and a clamp-opening-and-closing driving section 881 (see FIG. 10) mounted on the right-edge and left-edge frames 92*a* and 92*b*.

In this embodiment, an iron plate which is folded back may be used as the main body board 900 which is mounted so that it supports the right-edge and left-edge frames 92*a* and 92*b*. The right-edge and left-edge frames 92*a* and 92*b* are provided with motor-mounting areas, the right-edge frame 92*a* is provided with a mounting area for a clamper 82*a* and the left-edge frame 92*b* is provided with a mounting area for a clamper 82*b*, respectively.

The right-edge frame 92*a* shown in FIG. 7 is provided with a V-shaped groove 925 at its predetermined position and the left-edge frame 92*b* is also provided with a V-shaped groove 926 at its predetermined position. In this embodiment, when aligning the bundle of paper-sheets, a lower shaft 804 of the right end side lower arm 801*a* is engaged with the V-shaped groove 925 and a lower shaft 804 of the left end side lower arm 801*a* is engaged with the V-shaped groove 926. When moving the bundle of paper-sheets, the lower shaft 804 of the right end side lower arm 801*a* is disengaged from the V-shaped groove 925 and the lower shaft 804 of the lower arm 801*a* of the left end side is disengaged from the V-shaped groove 926.

Thus, it is possible to produce a restricted condition of the lower arms 801*a* of the right and left end sides when aligning the bundle of paper-sheets and it is possible to release the restricted condition of the lower arms 801*a* when moving the bundle of paper-sheets. Furthermore, when moving the bundle of paper-sheets, the bundle of paper-sheets 3" is apart from a bottom of the bundle-of-paper-sheets transport path of the binder paper alignment unit 30 so that any flexion occurred in the bundle of paper-sheets 3" when guiding it to a predetermined position (a center) of the binding process unit 40 can be reduced. This enables the bundle of paper-sheets 3" to be prevented from being scratched, damaged or shared in the paper-sheets.

Further, it is configured that the main body board 900 is fitted with the motor 89 for the alignment pins, which drives the alignment pins 85*a* and 85*b* upward and downward. As the motor 89, a DC motor is used. The motor 89 is engaged with a decelerating gear 98 (gear unit), which converts the motor rotation number at a predetermined decelerating ratio. The decelerating gear is engaged with an up-down rack member (hereinafter referred to as an UD rack 95), which moves up and down based on a torque converted at the predetermined decelerating ratio.

To one end of the UD rack 95, a plate 97 having a predetermined shape is connected. To the other end of the plate 97, arms 99*a* and 99*b* having predetermined shapes are engaged commonly around a rotary shaft. It is configured that the arms 99*a* and 99*b* are supported by the rotary shaft at their centers so that they may be opened in an X-shape or closed in a straight-line shape with respect to the rotary shaft (see FIGS. 8 and 9).

In this embodiment, one end of each of the arms 99*a* and 99*b* is engaged with the main body board 900 at its predetermined position in a rotatable and slidable manner. The other end of each of the arms 99*a* and 99*b* is engaged with a link 96 having a predetermined shape in a rotatable and slidable manner. The link 96 has, for example, an inverted π shape so that the other end of the arm 99*a* is engaged with one end of the inverted π shape in a rotatable and slidable manner and the other end of the arm 99*b* is engaged with the other end thereof in a rotatable and slidable manner.

With one end portion of the link 96, the alignment pin 85*a* is engaged and with the other end portion of the link 96, the alignment pin 85*b* is engaged. The alignment pins 85*a* and 85*b* constitute one example of bar-shaped bodies for alignment, and it is configured that they align the punched holes 3*a* in the bundle of paper-sheets 3" temporarily reserved in the paper-sheet-reserving unit 32. For example, the alignment pins 85*a* and 85*b* are inserted into predetermined two of the punched holes 3*a* in the bundle of paper-sheets 3" (see FIG. 3A).

It is to be noted that the HP detection sensor 93 is fitted to a predetermined position of the left edge frame 92*b* and detects a home position (lower edge) of each of the alignment pins 85*a* and 85*b* to output an HP detection signal S93. In the left edge frame 92*b*, the upper end detection sensor 94 is fitted to a predetermined position thereof above the HP detection sensor 93 and detects an upper edge position of each of the alignment pins 85*a* and 85*b* to output an upper end detection signal S94 (see FIG. 19). By thus configuring the alignment-pin-driving mechanism 91 and rotating the motor 89, the alignment pins 85*a* and 85*b* can be driven up and down.

Here, a description will be given of an operation example of the alignment pins 85*a* and 85*b* in the alignment-pin-driving mechanism 91 with reference to FIG. 8. In the figure, the right edge frame 92*a*, the left edge frame 92*b*, the shutter 83 and the main body board 900 will be omitted in order to make the description thereof clear.

Figure 8:
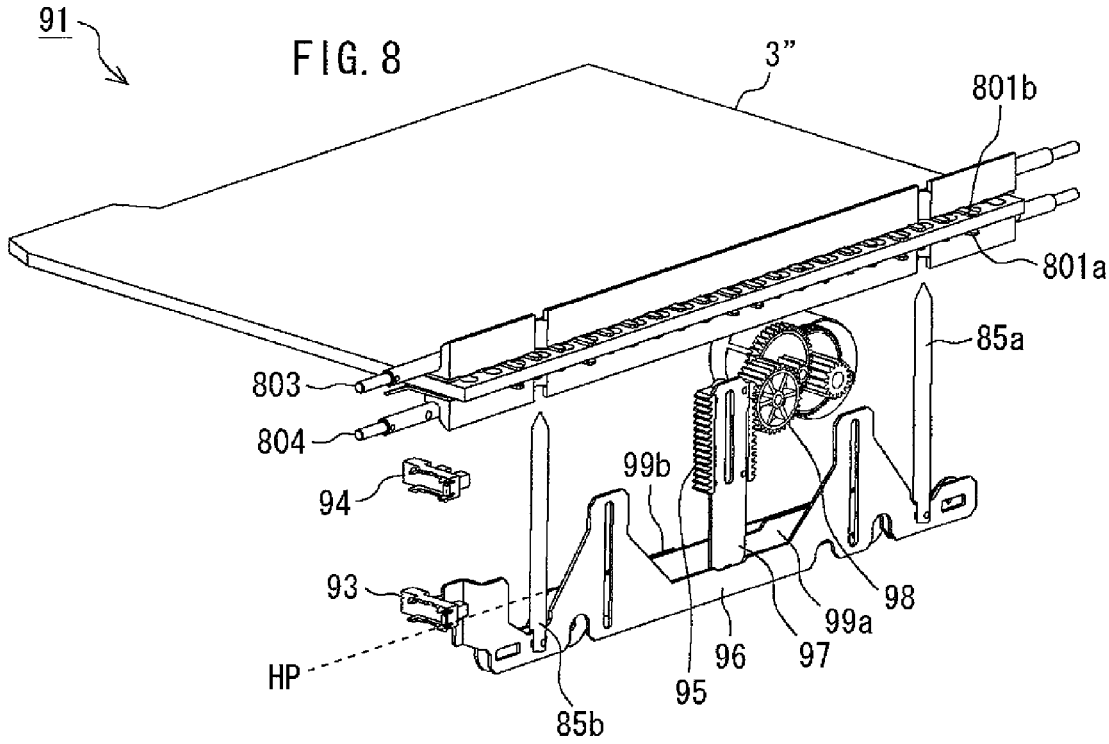

According to the operation example in the alignment-pin-driving mechanism 91 before the pins pass through as shown in FIG. 8, the alignment pins 85*a* and 85*b* disposed to the home position (HP) thereof retract to a predetermined position at a side where the bundle of paper-sheets 3" is transported along the paper-sheets-transporting direction I during paper alignment operation. The HP detection sensor 93 detects the home position of the alignment pins 85*a* and 85*b* and outputs the pin HP detection signal S93 to the control unit 50.

Figure 9:
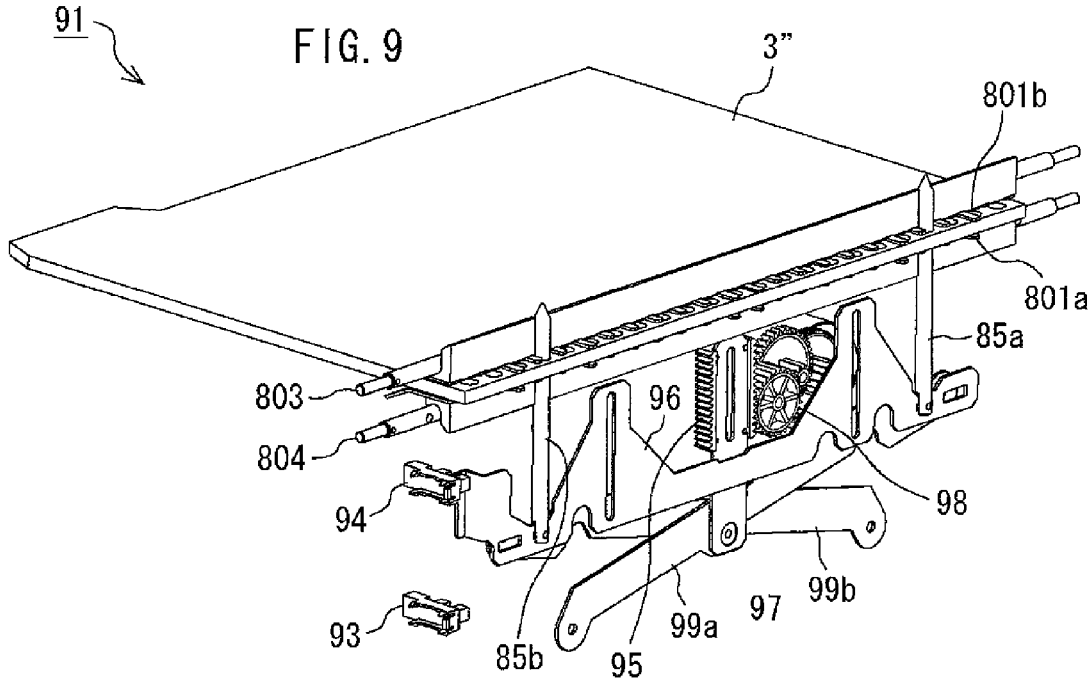

The following will describe an operation example in the alignment-pin-driving mechanism 91 when pins pass through. In FIG. 9, at the time of performing an alignment by pins, the alignment pins 85*a* and 85*b* project out of the side of the fixing clamp member (lower frame 801*a*) in a condition where the movable clamp member (upper frame 801*b*) is open. For example, if the motor 89 is turned ON and rotates in the clockwise direction at the home position shown in FIG. 8, the decelerating gear 98 rotates clockwise. If the decelerating gear 98 rotates clockwise, the UD rack 95 moves upward.

If the UD rack 95 moves upward, the rotary shaft of the arms 99*a* and 99*b* placed in the closed state is pulled upward. If the rotary shaft of the arms 99*a* and 99*b* is pulled upward, the arms 99*a* and 99*b* are opened in the X-shape. If the arms 99*a* and 99*b* are opened in the X-shape, the link 96 is pulled upward. If the link 96 is pulled upward, the alignment pins 85*a* and 85*b* are pulled upward. As a result thereof, the alignment pins 85*a* and 85*b* pass through the punched holes 3*a* in the bundle of paper-sheets 3". The upper end detection sensor 94 detects the upper end position of the alignment pins 85*a* and 85*b* and outputs the upper end detection signal S94 to the control unit 50. It is thus possible to insert the alignment pins 85*a* and 85*b* into the punched holes 3*a*, thereby aligning the bundle of paper-sheets 3".

Embodiment 1

The following will describe a configuration example of the clamp movement mechanism 80 as a first embodiment in the binder paper alignment unit 30 with reference to FIG. 10. In this embodiment, it is configured that after the bundle of paper sheets 3" is aligned, in clamp movement mechanism 80, only the paper-sheet fixation and movement section 880 is moved to a binding step for every bundle of paper sheets. The clamp movement mechanism 80 shown in FIG. 10 constitutes an example of the paper-sheet fixation and movement mechanism and is configured by including the main body board 900, the shutter 83, comb-shaped pressing members 84*a* and 84*b*, the paper-sheet fixation and movement section 880 and a clamp-opening-and-closing driving section 881.

The paper-sheet fixation and movement section 880 and a clamp-opening-and-closing driving section 881 constitute separated structures. In this embodiment, when the bundle of paper-sheets is aligned, the paper-sheet fixation and movement section 880 and a clamp-opening-and-closing driving section 881 are engaged with each other while when the bundle of paper-sheets is moved, the paper-sheet fixation and movement section 880 and a clamp-opening-and-closing driving section 881 are separated from each other. This is because the paper-sheet fixation and movement section 880 can drop by its weight to the binding process unit 40 with the bundle of paper-sheets 3" being fixed.

The paper-sheet fixation and movement section 880 is movably mounted with respect to the right edge frame 92*a* and the left edge frame 92*b* on both sides of the main body board 900 and operates to hold and fix the bundle of paper-sheets 3" or freely release it independently of the clamp-opening-and-closing driving section 881. The paper-sheet fixation and movement section 880 has a right end side clamp member (hereinafter merely referred to as a "clamper 82*a*") and a left end side clamp member (hereinafter merely referred to as a "clamper 82*b*"). Each of the clampers 82*a*, 82*b* has a lower arm 801*a* which constitutes one example of the fixing clamp member and an upper arm 801*b* which constitutes one example of the movable clamp member. It is configured that the upper arm 801*b* can be moved on an up and down direction.

For example, the lower arm 801*a* and the upper arm 801*b* are disposed at the respective right and left end sides of the binder paper alignment unit 30 and the upper arm 801*b* is driven so as to be closed for each one paper-sheet or each plural paper-sheets when aligning the bundle of paper-sheets for aligning the paper-sheets 3'. It is thus possible to correct the curl of the paper-sheet 3'. It is configured that the paper-sheet fixation and movement section 880 also moves with the bundle of paper-sheets 3" being fixed when the bundle of paper-sheets is moved. In this embodiment, it is configured that the bundle of paper-sheets 3" is released from the fixation when the bundle of paper-sheets is aligned and after the alignment-by-pins has been performed, the bundle of paper-sheets 3" is moved toward a downstream side from a paper-sheet curl pressing mechanism 31 along the paper-sheet transport direction with an end thereof at a side of punch holes being fixed.

In this embodiment, when the bundle of paper-sheets is aligned, the upper arm 801*b* stops while being opened to an arbitrary intermediate position which is a larger width than a thickness of the bundle of paper-sheets 3" and is smaller than a height of the bundle-of-paper-sheets-transporting path and waits at this position until it is detected by the upper end detection sensor 94 that the alignment pins 85*a*, 85*b* have reached the upper edge position. The left end side clamper 82*b* is also configured similarly.

It is configured that in the paper-sheet fixation and movement section 880, a spring 816 constituting an example of an urging member is mounted on the lower arm 801*a* and the upper arm 801*b* so that when the bundle of paper-sheets is aligned, the upper arm 801*b* is urged to a side of the fixed lower arm 801*a* to hold a clamp closing situation. When the bundle of paper-sheets is moved, it is configured so as to be always urged to a closing direction in order to hold the bundle of paper-sheets 3".

On the clamper 82*a* mounted on a right end side of the above-mentioned main body board 900, a joint plate 801 with limiting holes, which constitutes one example of a clamp-attaching board, is mounted. The joint plate 801 has a sword-pointed shape (a forward end sword-pointed shape) in which the forward end is pointed) and has an axis hole 807*a* on an end thereof and a long hole 808*a* at a predetermined position on the other end thereof. The joint plate 801 also has elongated limiting holes 806*a*, 806*b* to regulate clamp opening and closing.

The clamper 82*a* is configured to have the lower arm 801*a* and the upper arm 801*b*. With one end of the lower arm 801*a*, the lower shaft 804 is movably fitted. With one end of the upper arm 801*b*, the upper shaft 803 is movably fitted.

The clamper 82*b* facing the clamper 82*a* is provided with a joint plate having a similar sword-pointed shape and having an axis hole 807*a* on an end thereof and a long hole 808*a* at a predetermined position on the other end thereof. The other ends of the lower arm 801*a* and upper arm 801*b* at the left end side are engaged with an axis hole 807*b* of the joint plate 802 with the limiting holes, the other ends of the lower arm 801*a* and upper arm 801*b* at the right end side are engaged with an axis hole 807*a* of the joint plate 801 with the limiting holes and fulcrums each shared by the end of the lower arm 801*a* and the end of the upper arm 801*b* are movably engaged via a fulcrum shaft member 805 at right and left end sides.

The lower shaft 804 provided on the other edge of the lower arm 801*a* at the right end side is movably fitted into the limiting hole 806*a* having a long hole shape and similarly, the upper shaft 803 provided on the other edge of the upper arm 801*b* at the right end side is movably fitted into the limiting hole 806*b* having a long hole shape. The lower shaft 804, not shown, provided on the other edge of the lower arm 801*a* at the left end side is movably fitted into the limiting hole 806*a* of the joint plate 802 and similarly, the upper shaft 803 provided on the other edge of the upper arm 801*b* at the left end side is movably fitted into the limiting hole 806*b* of the joint plate 802.

In this embodiment, on the joint plates 801, 802 at right and left end sides, it is assembled so as to expose an edge portion of the lower shaft 804 at the limiting hole 806*a* and to expose an edge portion of the upper shaft 803 at the limiting hole 806*b*, respectively. It is thus possible to move the upper shaft 803 and the lower shaft 804 within the limiting holes 806*a*, 806*b* along a direction (hereinafter, referred to as a "clamp-opening-and-closing direction") perpendicular to the paper-sheet transporting direction in the joint plate 801 at the right end side. It is also possible to move the upper shaft 803 and the lower shaft 804 within the limiting holes 806*a*, 806*b* each having a long hole shape along the clamp-opening-and-closing direction in the joint plate 802 at the left end side.

The configuration members of the clamper 82*b* that are similar to those of the clamper 82*a* are formed similar to those of right end side so that the description thereof will be omitted. The clamper 82*b* and the clamper 82*a* are engaged with each other by their rear edges via the above-mentioned fulcrum shaft member 805 and at their front edges, the upper shaft 803 and the lower shaft 804 are movably engaged with the joint plates 801 and 802 with the limiting holes.

Further, the clampers 82*a*, 82*b* have a structure such that it moves toward a downstream side with respect to the main body board 900 along the paper-sheet transport direction I with the bundle of paper-sheets 3" being fixed. For example, it is configured that predetermined parts of the clamp movement mechanism 80 are movably engaged with the two sliding grooves 931, 922 of the right edge frame 92*a* and the two sliding grooves 932, 924 of the left edge frame 92*b*, which are shown in FIG. 7, and the clamp movement mechanism 80 moves toward a downstream side along these four sliding grooves 931, 922, 932 and 924. It is thus possible to move the clamp movement mechanism 80 toward the downstream side with respect to the main body board 900, the right and left edge frames 92*a*, 92*b*.

The clamp-opening-and-closing driving section 881 is mounted on the main body board 900 or the right edge frame 92*a* and the left edge frame 92*b*, which are positioned at both sides thereof, and drives the upper arms 801*b* of the left end side and the right end side. For example, the clamp-opening-and-closing driving section 881 is configured to include a motor 86, cams 87*a*, 87*b* and a gear unit 88 which are used for opening the upper arms 801*b* and pushes (moves) the upper arms 801*b* up to a predetermined position with respect to the lower arms 801*a* to release the bundle of paper-sheets 3" when the bundle of paper-sheets is aligned. Each of the cams 87*a*, 87*b* has a deformed ellipse shape in which two arcs of circles (curved parts) that are different from each other in a radius and a projection shape between the arcs of circles having the different radii are formed (see FIG. 22).

In this embodiment, the clamp-opening-and-closing driving section 881 keeps the clamp-opening situation by exceeding the urging force by the spring 816 shown in FIG. 10 against the upper arms 801*b* of the paper-sheet fixation and movement section 880. It is thus possible to align the bundle of paper-sheets while the paper-sheet fixation and movement section 880 is opened.

The clamp-opening-and-closing driving section 881 operates to start movement of the upper arms 801*b* with respect to the lower arms 801*a* at the same time when the alignment-pin-driving mechanism 91 passes the alignment pins 85*a*, 85*b* through the punch holes of the paper-sheets 3'. It is thus possible to reduce any frictional resistance between the paper-sheets. Further, by setting the retracted position of the upper arms 801*b* with respect to the lower arms 801*a* to an intermediate position, the bundle of paper-sheets can be aligned without lifting the paper-sheets 3' by the alignment pins 85*a*, 85*b* so that it is possible to reduce any variations in the conditions of the paper-sheets 3'. Here, the intermediate position is referred to as a position between the clamp-closing position and the clamp-complete-opening position.

The motor 86 of the clamp-opening-and-closing driving section 881 is mounted in a motor mounting region provided inside the left edge frame 92*b* shown in FIG. 7. It is configured that the motor 86 is engaged with the gear unit 88, the motor rotational frequency is converted by a predetermined gear ratio, and the motor rotational force is transmitted to the cams 87*a* and 87*b*. The gear unit 88 is mounted with the one cam 87*b*. The cam 87*b* is mounted on the other cam 87*a* through a cam cooperative member 819.

Each of the upper arms 801*b* of the clampers 82*a*, 82*b* includes a roller 826 for opening and closing the clamp. Each roller 826 forms a cam operative region and is engaged with the cam 87*a* or 87*b* so as to receive any force from the clamp-opening-and-closing driving section 881, thereby opening the upper arms 801*b*.

For example, when the bundle of paper-sheets is aligned, the motor is driven in the clamp-opening-and-closing driving section 881 so that the cams 87*a*, 87*b* are driven through the gear unit 88. The cam 87*a* pushes the roller of the upper arm 801*b* of the right end side to open the clamper 82*a* of the right end side and the cam 87*b* pushes the roller 826 of the upper arm 801*b* of the left end side to open the clamper 82*b* of the left end side. In this embodiment, the clamp-opening-and-closing operation is performed by attaching the rollers 826 to the cams 87*a*, 87*b* with cooperation of the springs 816.

When the bundle of paper-sheets is moved (in the bind process), the cams 87*a*, 87*b* are driven so that the upper arms 801*b* can be retracted from the rollers 826, thereby causing them to be closed by the springs 816 to hold the bundle of paper-sheets 3". In this condition, the rollers 826 of the paper-sheet fixation and movement section 880 and the cams 87*a*, 87*b* of the clamp-opening-and-closing driving section 881 are disengaged with each other, so that the clampers 82*a*, 82*b* can be moved to the binding process unit 40 with the bundle of paper-sheets being held. It is thus configured that the respective clampers 82*a*, 82*b* are opened or closed in synchronization with them.

When aligning the bundle of paper-sheets, the paper-sheet fixation and movement section 880 and the clamp-opening-and-closing driving section 881 are connected through the rollers 826 and the cams 87*a*, 87*b* and when moving the bundle of paper-sheets (in the bind process), it is separated from the clamp-opening-and-closing driving section 881 so that the clampers 82*a*, 82*b* are always closed, thereby enabling the condition in which the bundle of paper-sheets 3" is held to be kept. Namely, when the paper-sheet fixation and movement section 880 is separated from the clamp-opening-and-closing driving section 881, the condition in which the bundle of paper-sheets 3" is fixed is kept so that it can drop by its weight to the binding process unit 40 under this condition.

It should be noted that the alignment-pin-driving mechanism 91 shown in FIG. 7 is arranged on a side of the lower arms 801*a*. When the bundle of paper-sheets is aligned, the clamp-opening-and-closing driving section 881 closes the upper arms 801*b* to the lower arms 801*a* with the alignment-pin-driving mechanism 91 passing the alignment pins 85*a*, 85*b* through the punch holes 3*a*, to fix the bundle of paper-sheets 3". It thus becomes possible to align the bundle of paper-sheets surely when the bundle of paper-sheets is aligned.

A shutter 83 is movably mounted on the front face of the main body board 900 and operates so as to limit the release of the bundle of paper-sheets 3" stored in the paper-sheet-reserving unit 32. It is configured that the shutter 83 is driven up and down in the direction perpendicular to the transporting direction of the bundle of paper-sheets 3". It is configured that sliding and guiding members 811, 812 are provided on both sides of the shutter 83 and the shutter 83 slides along the sliding and guiding members 811, 812. In this embodiment, when the clampers 82*a*, 82*b* make the bundle of paper-sheets 3" to be in a free release state, it is possible to stop the natural drop of the bundle of paper-sheets 3" by closing the shutter 83.

The shutter 83 is mounted on a solenoid via a driving shaft, which is not shown, and it is configured that the shutter 83 opens and closes by the reciprocating movement thereof. Of course, it is not limited to this and the shutter 83 can open and close by converting a rotational movement of the motor, which is not shown, to a reciprocating movement thereof.

Also, the alignment-pin-driving mechanism 91 is provided inside the front surface part of the main body board 900 and the alignment pins 85*a*, 85*b* are driven upward and downward. In this embodiment, it is configured that by passing the alignment pins 85*a*, 85*b* into the punch holes 3*a* of the bundle of paper-sheets 3" before the binding process, the positions thereof are realigned. The front edges of respective alignment pins 85*a*, 85*b* have conical shapes. For example, the bundle of paper-sheets 3" is made to be sandwiched and held between the upper portion pressing member 84*a* and the lower portion pressing member 84*b* before inserting the alignment pins 85*a*, 85*b* as shown in FIG. 11B.

Here, a description will be given of a configuration example of the comb-shaped pressing members 84*a*, 84*b* with reference to FIGS. 11A through 11C. With reference to the alignment-pin-driving mechanism 91 shown in FIG. 11B, a situation before the alignment pins 85*a*, 85*b* thereof are inserted is shown. The alignment pins 85*a*, 85*b* shown in FIG. 11C shows a situation after they are inserted.

Figure 11A:
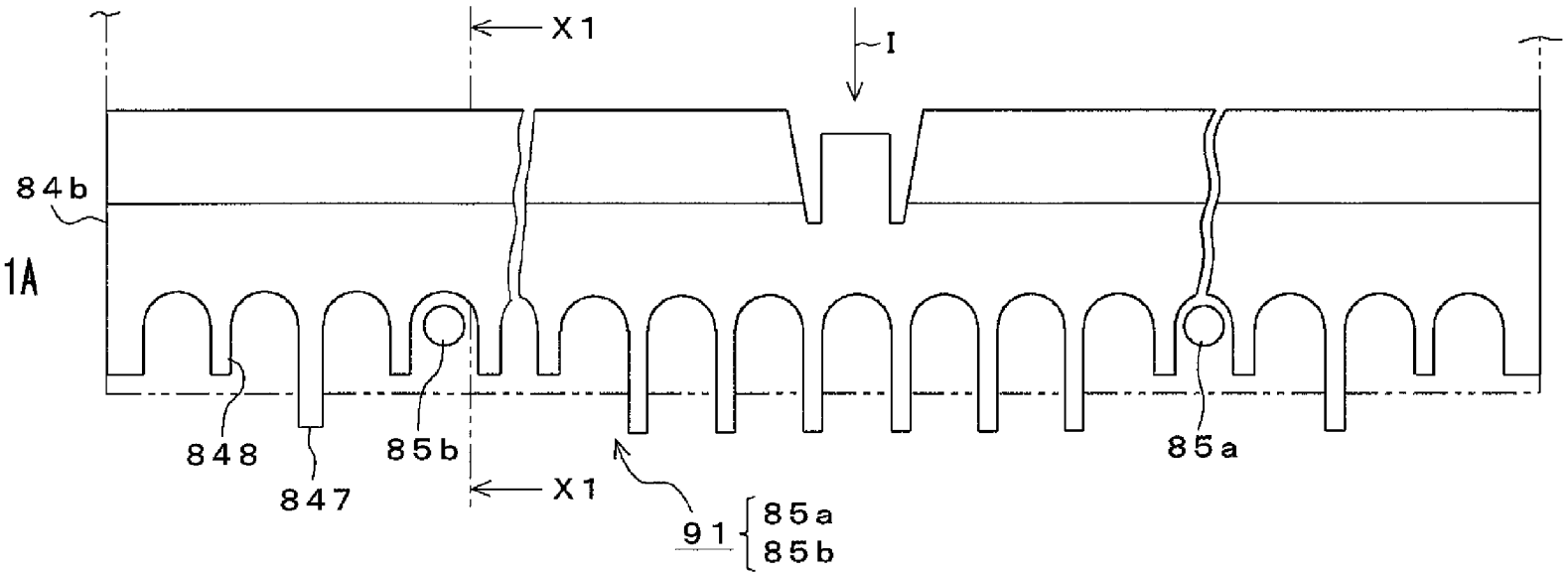
FIG. 11A is a diagram for showing a configuration example of a comb-shaped pressing member and an operation example thereof.
Figure 11B:
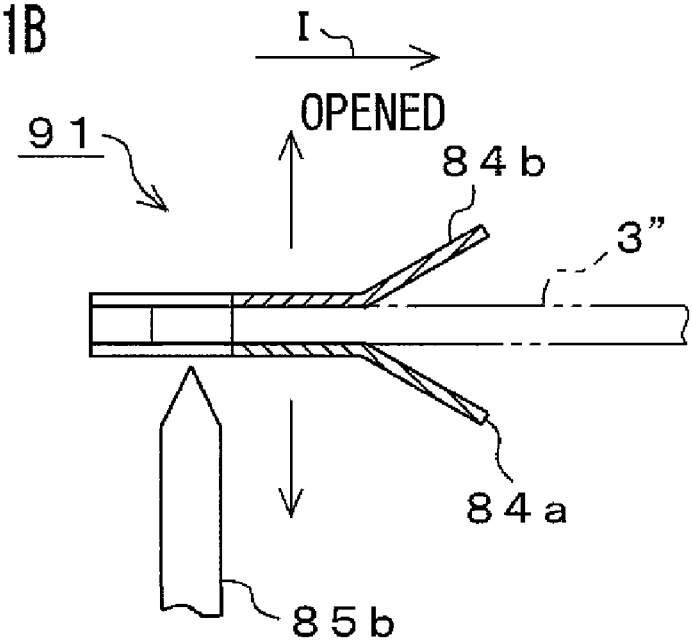
FIG. 11B is a diagram for showing a configuration example of the comb-shaped pressing member and an operation example thereof.
Figure 11C:
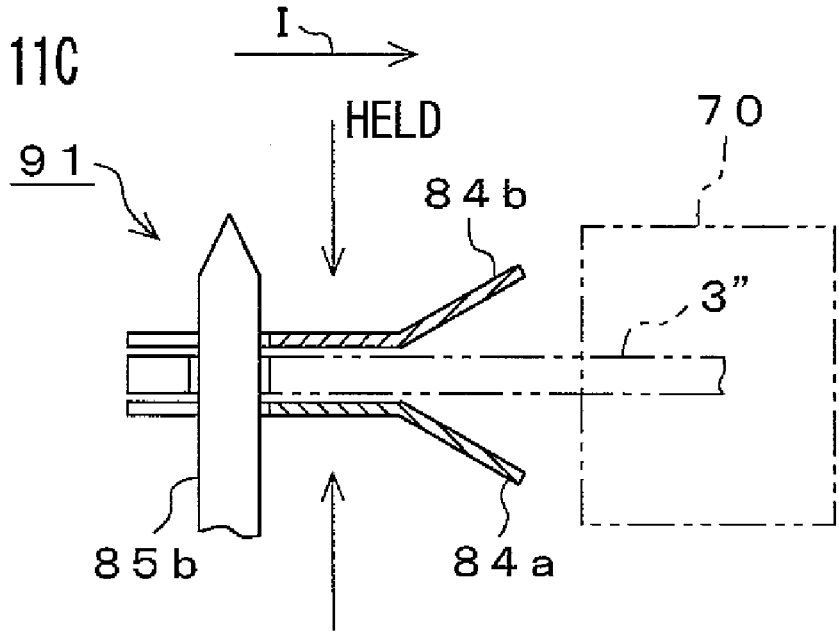
FIG. 11C is a diagram for showing a configuration example of the comb-shaped pressing member and an operation example thereof.

In this embodiment, the comb-shaped upper part pressing member 84*b* shown in FIG. 11A is mounted on the upper shaft 803 shown in FIG. 10 and the lower part pressing member 84*a* having the same shape is mounted on the lower shaft 804. The comb-shaped upper part pressing member 84*b* has comb tooth sites each cut in a U-shape. It is configured that a disposition pitch of the comb tooth sites is the same as a disposition pitch of the punched holes 3*a* in the bundle of paper-sheets 3".

The comb-shaped sites are formed with a mixture of long tooth sites 847 and short tooth sites 848. The long tooth sites 847 are arranged so as to project forward more than the edge portion of the bundle of paper-sheets 3", while the short tooth sites 848 is arranged so as to project short of the edge portion of the bundle of paper-sheets 3". This is done so in order to fit the long tooth sites 847 into sites selectively opened in the shutter 83, thereby improving an accuracy at which the upper part pressing member 84*b* and the lower part pressing member 84*a* are held and fixed and the function of closing the shutter.

In this embodiment, in order to align the positions of the holes in the bundle of paper-sheets 3" by using the alignment pins 85*a*, 85*b*, the clampers 82*a*, 82*b* are opened in a condition where the shutter 83 shown in FIG. 10 is closed. Further, as shown in FIG. 11C, the alignment pin 85*b* is inserted into the punched hole 3*a* in the bundle of paper-sheets 3". It is configured that in this moment, the side jogger 70 indicated by a dash-and-two-dots line facilitates the insertion of the alignment pins 85*a* and 85*b* by swinging the both sides of the bundle of paper-sheets 3" and also aligns the positions of the holes in the bundle of paper-sheets 3". This is done so in order to facilitate the insertion of the binding component 43 into the punch holes 3*a*.

Figure 12:
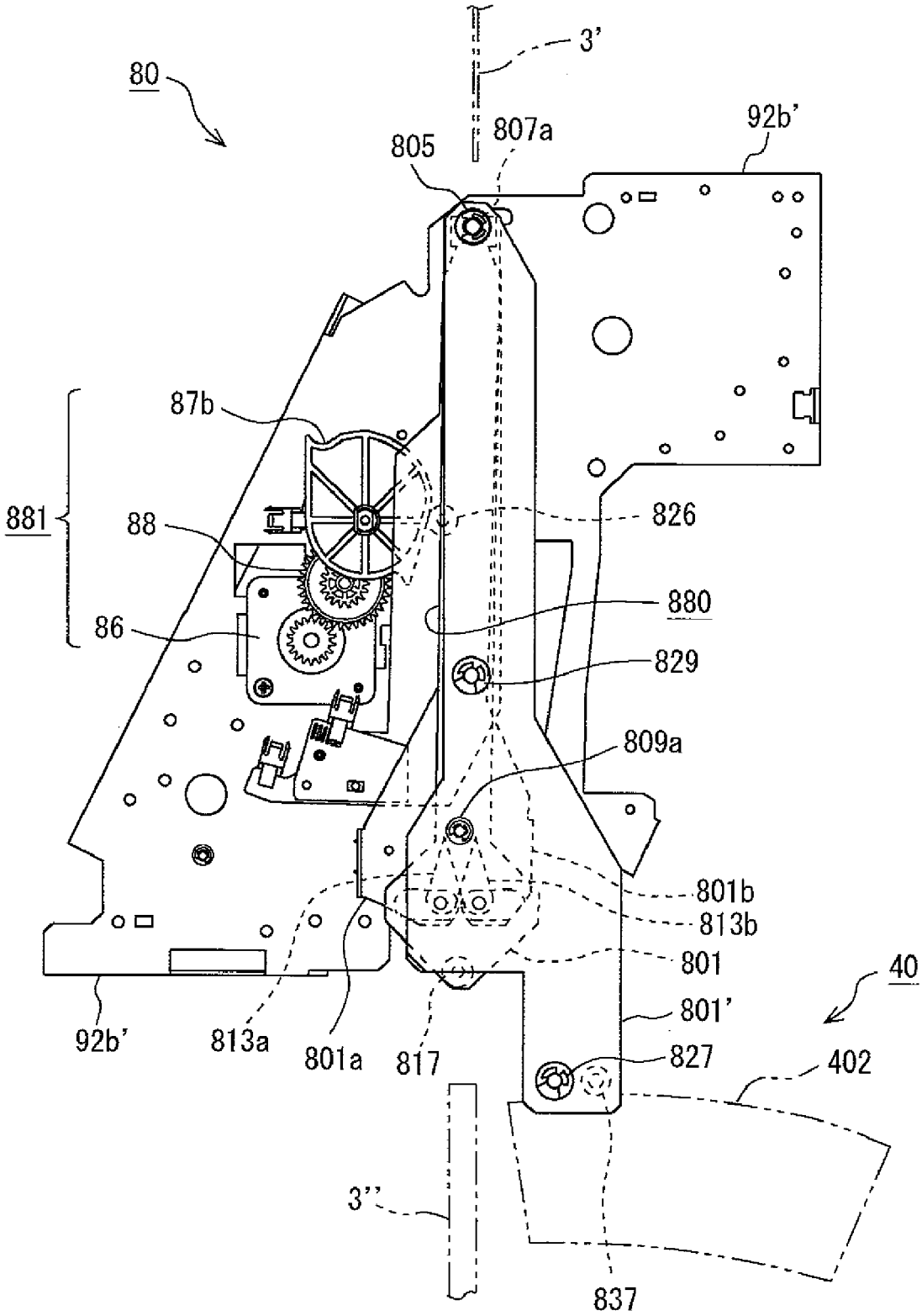
FIG. 12 is a front view showing a pantograph structure example of a paper-sheet fixation and movement section 880 in the clamp movement mechanism 80.

The following will describe an example of a pantograph structure of the paper-sheet fixation and movement section 880 in the clamp movement mechanism 80 with reference to FIG. 12. In the paper-sheet fixation and movement section 880 that is capable of being separated from the clamp-opening-and-closing driving section 881, which are shown in FIG. 12, oval isometric link members 813*a*, 813*b* shown by broken lines are provided.

In this embodiment, the lower shaft (a shaft) 804 on the lower arm 801*a* and the upper shaft (a shaft) 803 on the upper arm 801*b* are respectively engaged with one ends of isometric link members 813*a*, 813*b* as well as the other ends of the corresponding isometric link members 813*a*, 813*b* are engaged with the long hole 808*a* (see FIG. 10) of the joint plate 801 via an engaging member 809*a*.

Although not shown, on the other side, the lower shaft 804 on the lower arm 801*a* and the upper shaft 803 on the upper arm 801*b* are respectively engaged with one ends of isometric link members 813*a*, 813*b* as well as the other ends of the corresponding isometric link members 813*a*, 813*b* are engaged with the long hole 808*b* of the joint plate 802 via an engaging member 809*b*, which results in a fact that the paper-sheet fixation and movement section 880 forms a pantograph structure.

In this embodiment, it is configured that in each of the joint plates 801, 802, the upper arm 801*b* and the lower arm 801*a* are linked by the isometric link members 813*a*, 813*b* having the pantograph structure so that the engaging member 809*a* of the isometric link members 813*a*, 813*b* is always positioned at a center of the upper arm 801*b* and the lower arm 801*a*.

Such a pantograph structure enables a fulcrum of the isometric link members 813*a*, 813*b* of one side to be connected with the joint late 801 by the engaging member 809*a* and enables a fulcrum of the isometric link members 813*a*, 813*b* of the other side to be connected with the joint plate 802 by the engaging member 809*b*, which is not shown, whereby allowing a center position of the bundle of paper-sheets 3" to be directly guided to the movement mechanism 41 for the binding process in the binding process unit 40, thereby enabling a guide structure of the center position of the bundle of paper-sheets 3" to be simplified. Further, the center position varies linearly based on a thickness of the bundle of paper-sheets 3" so that complex process and control become unnecessary.

A roller member 817 is provided at a forward end side of the joint plate 801 that has the engaging member 809*a* engaging with such isometric link members 813*a*, 813*b* and a roller member 818 is also provided at a forward end side of the joint plate 802, as shown in FIG. 10. The roller members 817 and 818 are guided by the openings 44*a* and 44*b* having each Y-shape provided on a forward end of the binding process unit 40 shown in FIG. 2 and set the bundle of paper-sheets 3" on a predetermined binding position on a next step. Here, the forward end side of the joint plate 801 is referred to as a position against a terminal side on which the axis hole 807*a* for the fulcrum is provided.

In this embodiment, the fulcrum shaft member 805 is movably engaged with the sliding grooves 922 and 924 having long hole shapes as shown in FIG. 7. The engaging members 829, respectively, are movably engaged with the sliding grooves 921 and 923. In the clamp movement mechanism 80, the roller member 817 of the joint plate 801, the engaging member 809*a* of the isometric link members 813*a*, 813*b* thereof and the axis hole 807*a* for the fulcrum thereof are arranged on a straight line. The roller member 818 of the joint plate 802 thereof, the engaging member 809*b* of the isometric link members 813*a*, 813*b* thereof and the axis hole 807*b* for the fulcrum thereof are also arranged on a straight line.

In this embodiment, on the joint plate 801 shown in FIG. 10, a lead plate 801' having a bent shape is provided. An end of the lead plate 801' is also engaged together with the joint plate 801 with the fulcrum shaft member 805 being shared, thereby the fulcrum shaft member 805 being movably engaged with the sliding grooves 922, 924 shown in FIG. 7. On a middle portion of the lead plate 801', the engaging member 829 is also movably engaged with the sliding groove 921 or 923 shown in FIG. 7 together with the joint plate 801. The joint plate 802 and a lead plate 802' on the opposite side are similarly configured.

In the lead plate 801' provided on the above-mentioned joint plate 801, a roller member 827 is provided at a lower end thereof. The roller member 827 is engaged with a cam 402 having a fan shape, which is provided on the movement mechanism 41.

A shape of the cam 402 has a part of an arc of a circle centering around the movement mechanism rotating axis 41*d* shown in FIG. 2. It is configured that the cam 402 keeps on attaching the roller member 827 of the paper-sheet fixation and movement section 880 thereto. The cam 402 is arranged on a position covering a whole movement range of the movement mechanism 41 and receiving (following) the roller member 827 of the paper-sheet fixation and movement section 880. In other words, even if the movement mechanism 41 inclines its posture to either a downward direction of the binder cassette 42 or a downward direction of the binder paper alignment unit 30, it is arranged on a position receiving (following) a roller member 837 of the paper-sheet fixation and movement section 880.

Thus, by configuring the clamp movement mechanism 80 and its peripheral mechanism and attaching the main body board 900, the right edge frame 92*a* and the left edge frame 92*b* to which these parts are attached to a chassis 45 of the binding process unit 40, the paper-sheet alignment and binding processing unit 110 as one block can be configured.

The following will describe a connection example of the paper-sheet fixation and movement section 880 and the movement mechanism 41 in the paper-sheet alignment and binding processing unit 110. It is configured that the binding process unit 40 is provided on a downstream side of the clamp movement mechanism 80 shown in FIG. 13 and attaches a binding component 43 to the bundle of paper-sheets 3". In this embodiment, when aligning the bundle of paper-sheets, the cam 402 is lifted upwards so that the paper-sheet fixation and movement section 880 performs the clamp-opening-and closing operation.

It is configured that when moving the bundle of paper-sheets, the movement mechanism 41 receives the binding component 43 from the binder cassette 42 and is moved from the downward direction of the binder cassette 42 to the downward direction of the binder paper alignment unit 30 as well as the cam 402 is brought downwards by the movement mechanism 41 so that the paper-sheet fixation and movement section 880 is configured to drop by its weight from its home position HP' to a retracted position of the cam 402. In this moment, by the openings 44*a*, 44*b* (engaging portions) each having Y-shape which are provided on a forward end of the movement mechanism 41, the roller members 817, 818 provided on the lower end of the paper-sheet fixation and movement section 880 are received.

When the binding component 43 is attached to the bundle of paper-sheets 3" by the movement mechanism 41, the cam 402 is lifted upwards and the movement mechanism 41 is retracted to the downward direction of the binder cassette 42 so that the paper-sheet fixation and movement section 880 returns to its home position HP' and the lower arm 801*a* and the upper arm 801*b* become movable when delivering the booklet.

Thus, the roller members 817, 818 are engaged with the openings 44*a*, 44*b* each having Y-shape in the binding process unit 40 with a self-aligning method when moving the bundle of paper-sheets (in the binding process) so that it is possible to link the clamp-opening operation conforming with an operation timing of a ring binding by the binding process unit 40. In this embodiment, a center position of the bundle of paper-sheets 3" is guided to a center position of the binding component 43 when performing the binding process by the binding component 43 on the bundle of paper-sheets and the binding process in which the binding component 43 is certainly bound with the bundle of paper-sheets 3" can be performed.

The following will describe operation examples in the clamp movement mechanism 80 with reference to FIGS. 14 to 17.

In the embodiment, according to the operation example (part one) in the clamp movement mechanism 80, an assumption is a case where each time the paper-sheet 3' comes in the paper-sheet-reserving unit 32 and butts against the shutter 83 in a condition where the shutter 83 shown in FIG. 10 is closed, the upper arm 801*b* is closed. The alignment pin 85*a* stays in a waiting state where it is not inserted into the bundle of paper-sheets 3".

Figure 14:
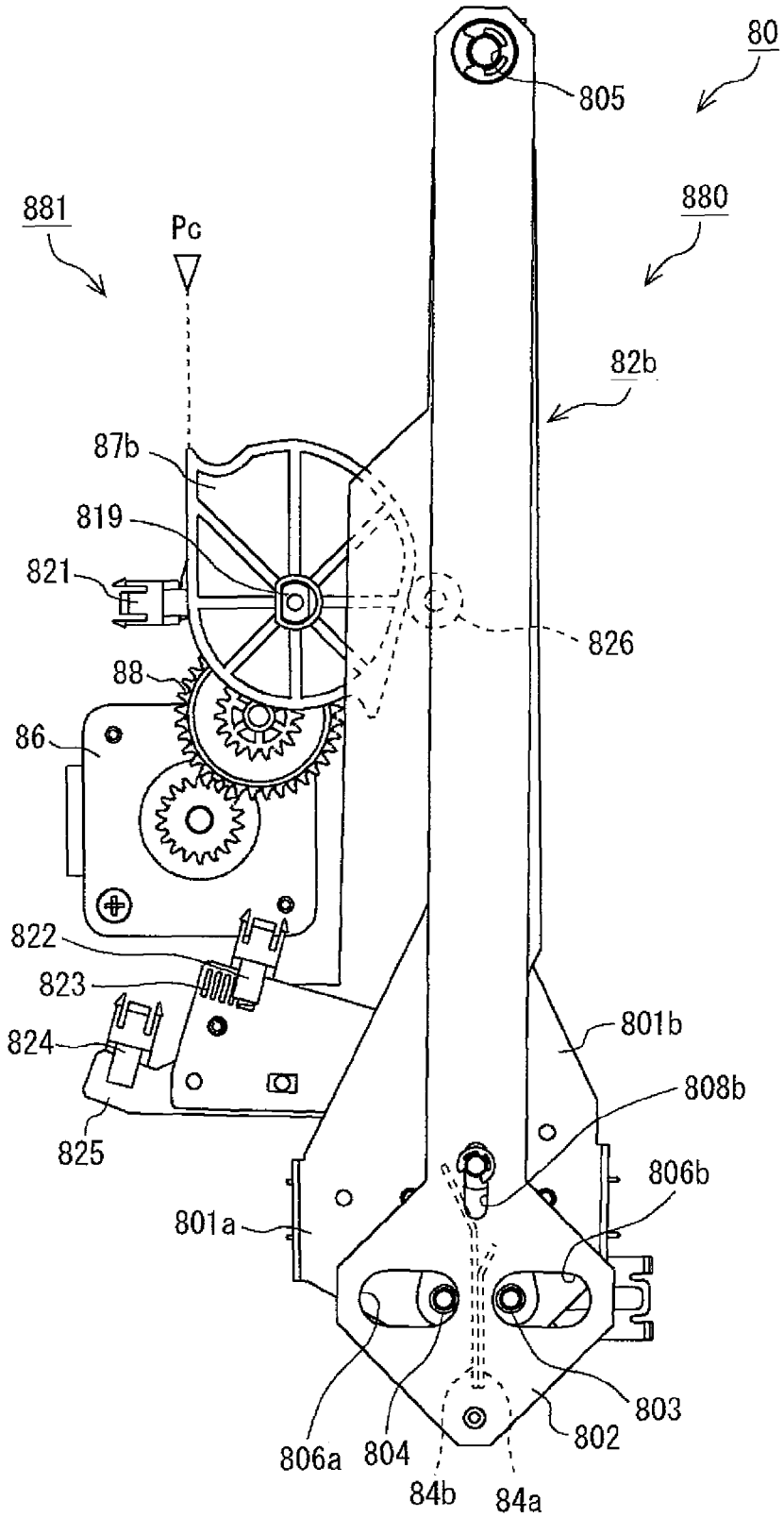
FIG. 14 is a front view showing an operation example (No. 1 thereof) at the time of alignment of a bundle of paper-sheets in the clamp movement mechanism 80.

According to the operation example when aligning the bundle of paper-sheets in the clamp movement mechanism 80 shown in FIG. 14, the clampers 82*b* and 82*a* perform clamping operation at the front ends thereof with reference to the fulcrum shaft member 805 at their rear ends thereof under a state where the upper shaft 803 and the lower shaft 804 are limited by the limiting holes 806*a* and 806*b* in the joint plates 801 and 802 having the limiting holes.

In this embodiment, the comb-shaped upper part pressing member 84*a* attached to the upper shaft 803 and the comb-shaped lower part pressing member 84*b* attached to the lower shaft 804, which are shown in FIG. 14, hold the paper-sheets 3' coming into the paper-sheet-reserving unit 32. In this moment, it is configured that the long tooth sites 847 shown in FIG. 11A sandwich the bundle of paper-sheets 3" at a position to which they project forward than the paper edge portion, while the short tooth sites 848 sandwich the bundle of paper-sheets 3" at a position to which they project short of the paper edge portion. Further, the long tooth sites 847 are disposed to the opening site in the shutter 83, thereby enabling improving the accuracy of holding and fixing by the upper part pressing member 84*a* and the lower part pressing member 84*b* and the accuracy of closing by the shutter 83.

In this moment, the cams 87*a* and 87*b* take on a predetermined posture at a cam retracting position Pc (non-home position). For example, it is a condition where protrusions of the cams 87*a* and 87*b* face right beside. This condition is a condition where the clampers 82*a* and 82*b* are closed by the urging force of the spring 816 shown in FIG. 10.

In this embodiment, it is configured that a home position sensor 821 (hereinafter referred to as an HP sensor 821) for clamping is disposed near the cam 87*b* and detects a home position (HP) of the clamper 82*b* etc. to output a home position detection signal (hereinafter referred to as a cam HP detection signal S21) to the control unit 50. The home position HP of the clamper 82*b* is set to a position (clamp closing position) to which the upper arms 801*b* have moved lower most. The clamper 82*a* is also set similarly and its description will be omitted.

Further, a paper-sheets thickness detection sensor 822 is disposed on the main body board 900 and a slit portion 823 is formed in each of the upper arms 801*b* and may be used in conjunction with this paper-sheets thickness detection sensor 822. As the paper-sheets thickness detection sensor 822, a transmission type photo-sensor is used.

For example, the slit portion 823 includes slit shapes having a predetermined pitch therebetween, so that each time the bundle of paper-sheets 3" reaches a constant thickness, an edge of any upper arm 801*b* is detected by the paper-sheets thickness detection sensor 822, and the upper arms 801*b* perform opening and closing operations, thereby detecting the thickness of the paper-sheets. An amount when closing and opening the clampers 82*a*, 82*b* varies based on the thickness of the bundle of paper-sheets so that by detecting the edge thereof, it is possible to detect the thickness of the bundle of paper-sheets 3". It is thus configured that the paper-sheets thickness detection sensor 822 detects the thickness of the paper-sheets 3" coming into the binder paper alignment unit 30 and stacked (bundled) there and output a paper thickness detection signal (not shown) to the control unit 50. It should be noted that the clamp position is positioned at a position where the binding component 43 is bound so that it is possible to detect the thickness when performing the binding operation accurately.

A 50-paper-sheets thickness detection sensor (hereinafter referred to as a 50-sheets sensor 824) is also disposed on the main body board 900 adjacent to the paper-sheets thickness detection sensor 822 and a light blocking unit 825 is mounted on the upper arms 801*b* and used in conjunction with this 50-sheets sensor 824. It is configured that the 50-sheets detection sensor 824 detects a thickness of the paper-sheets 3"

when they are stacked as many as 50 sheets and output a 50-sheets detection signal S42 to the control unit 50.

Figure 15:
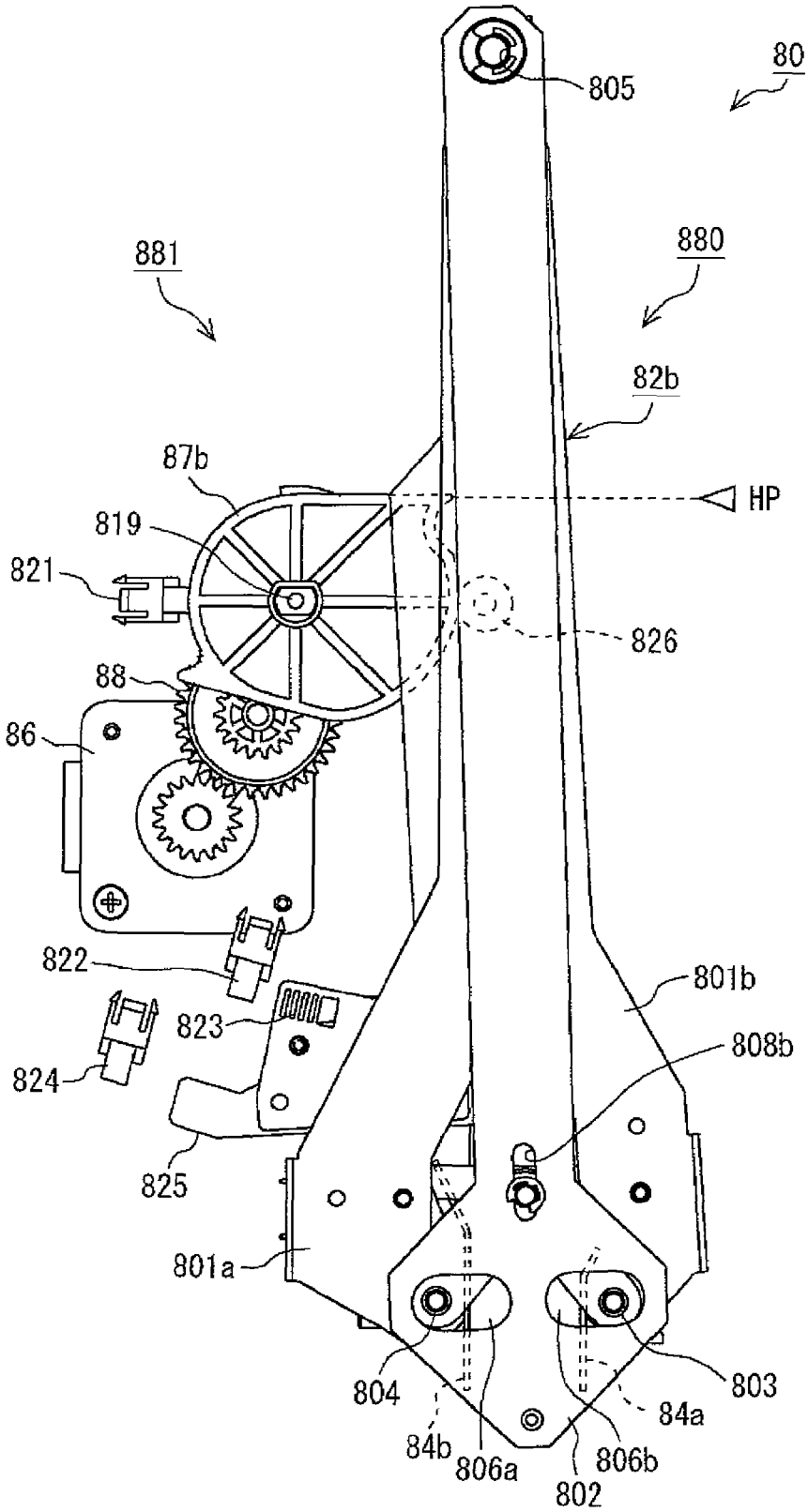
FIG. 15 is a front view showing the operation example (No. 2 thereof) at the time of alignment of the bundle of paper-sheets in the clamp movement mechanism 80.

According to the operation example (part two) when aligning a bundle of paper-sheets in the clamp movement mechanism 80 shown in FIG. 15, when the paper-sheet 3' comes in and when the positions of the punched holes 3*a* in the bundle of paper-sheets 3" are to be aligned, the clampers 82*a* and 82*b* may be opened in a condition where the shutter 83 shown in FIG. 10 is closed, and then the alignment pins 85*a* and 85*b* are inserted by the alignment-pin-driving mechanism 91 shown in FIG. 7.

Figure 13:
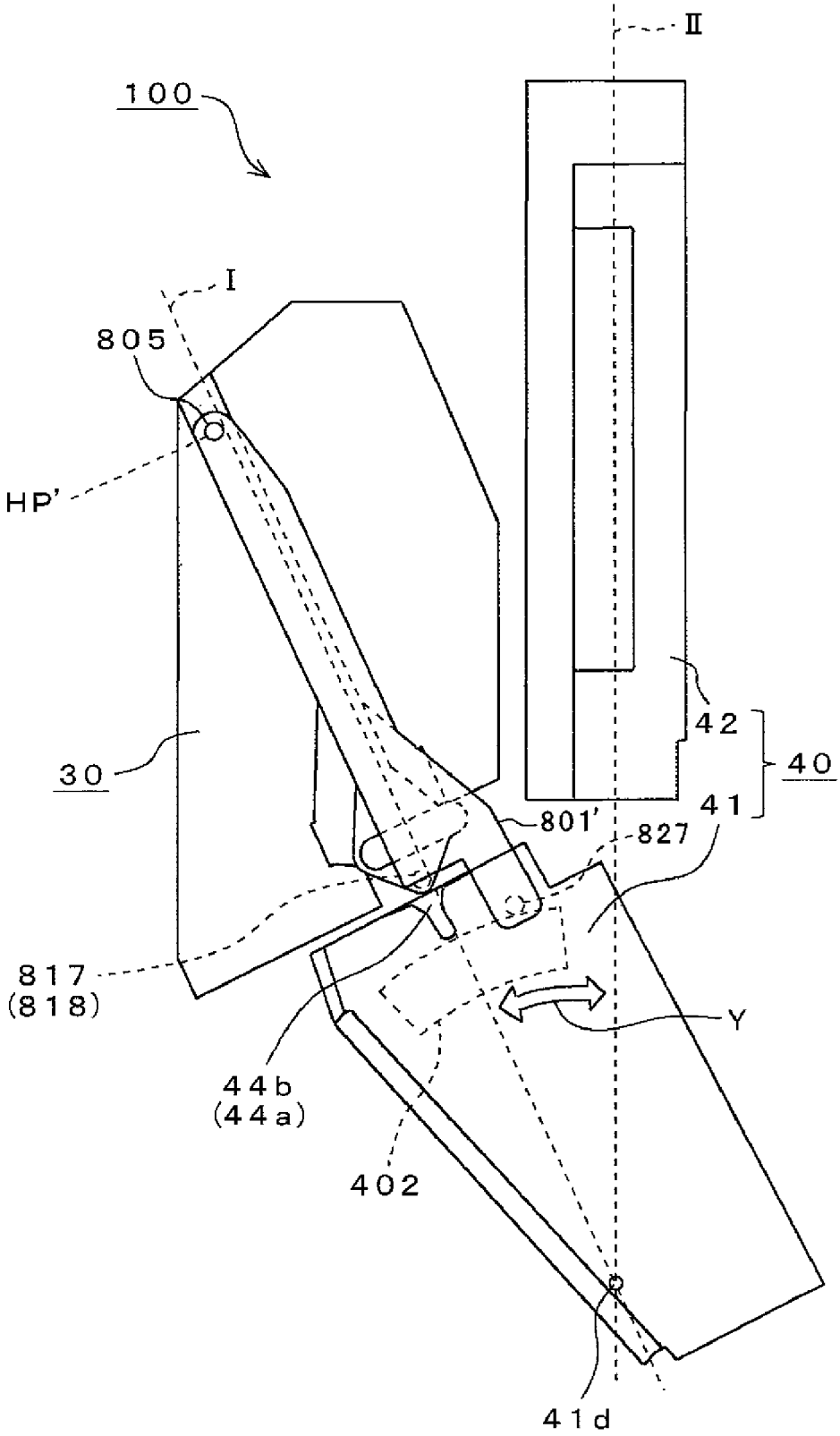
FIG. 13 is a front view showing a connection example of the paper-sheet fixation and movement section 880 and a movement mechanism 41 in the paper-sheet alignment and binding processing unit 110.

In the clamp movement mechanism 80, the cams 87*a* and 87*b* take on predetermined postures at a clamp opening position (home position HP) thereof. For example, in a condition where the clampers 82*a* and 82*b* shown in FIG. 13 are closed, the motor 86 converts a rotation number of the motor via the gear unit 88 based on a predetermined gear ratio and transmits a motor torque to the cams 87*a* and 87*b*. As a result thereof, a condition occurs where the cams 87*a* and 87*b* rotate by 90 degrees clockwise from the cam retracting position Pc.

In this moment, at each of the clampers 82*a* and 82*b*, the protrusion of the cam 87*a* presses the roller 826 of the upper arm 801*b* of the clamper 82*a* and the protrusion of the cam 87*b* presses the roller 826 of the upper arm 801*b* of the clamper 82*b*, thereby opening the clampers 82*a* and 82*b* synchronously with each other.

In the joint plates 801 and 802 having the limiting holes, the lower arm 801*a* and the upper arm 801*b* operate to open by using the fulcrum shaft member 805 as a movable reference. In this moment, the lower shaft 804 and the upper shaft 803 are limited in movement by the elongated limiting holes 806*a* and 806*b* in the joint plates 801 and 802, so that a width to which the clamps are opened may be limited in the joint plates 801 and 802. The driving force is transmitted to the lower shaft 804 attached to the lower arms 801*a* movably and the upper shaft 803 attached to the upper arms 801*b* movably.

As a result thereof, the bundle of paper-sheets 3" is released free by the comb-shaped upper part pressing member 84*b* attached to the upper shaft and the comb-shaped lower part pressing member 84*a* attached to the lower shaft 804. Even if these clampers 82*a* and 82*b* makes the bundle of paper-sheets 3" free released, the bundle of paper-sheets 3" may be prevented from falling naturally because the shutter 83 is closed.

Then, it is configured that the motor 89 is driven and the normal-directional rotation movement of the motor 89 is converted into a pin raising movement by the alignment-pin-driving mechanism 91 shown in FIG. 7, thus permitting the alignment pins 85*a* and 85*b* to pass through the punched holes 3*a* in the bundle of paper-sheets 3". In this moment, it is configured that the side jogger 70 shown in FIG. 6 facilitates the insertion of the alignment pins 85*a* and 85*b* by swinging the both sides of the bundle of paper-sheets 3". It is thus possible to align the positions of the holes 3*a* in the bundle of paper-sheets 3".

Figure 16:
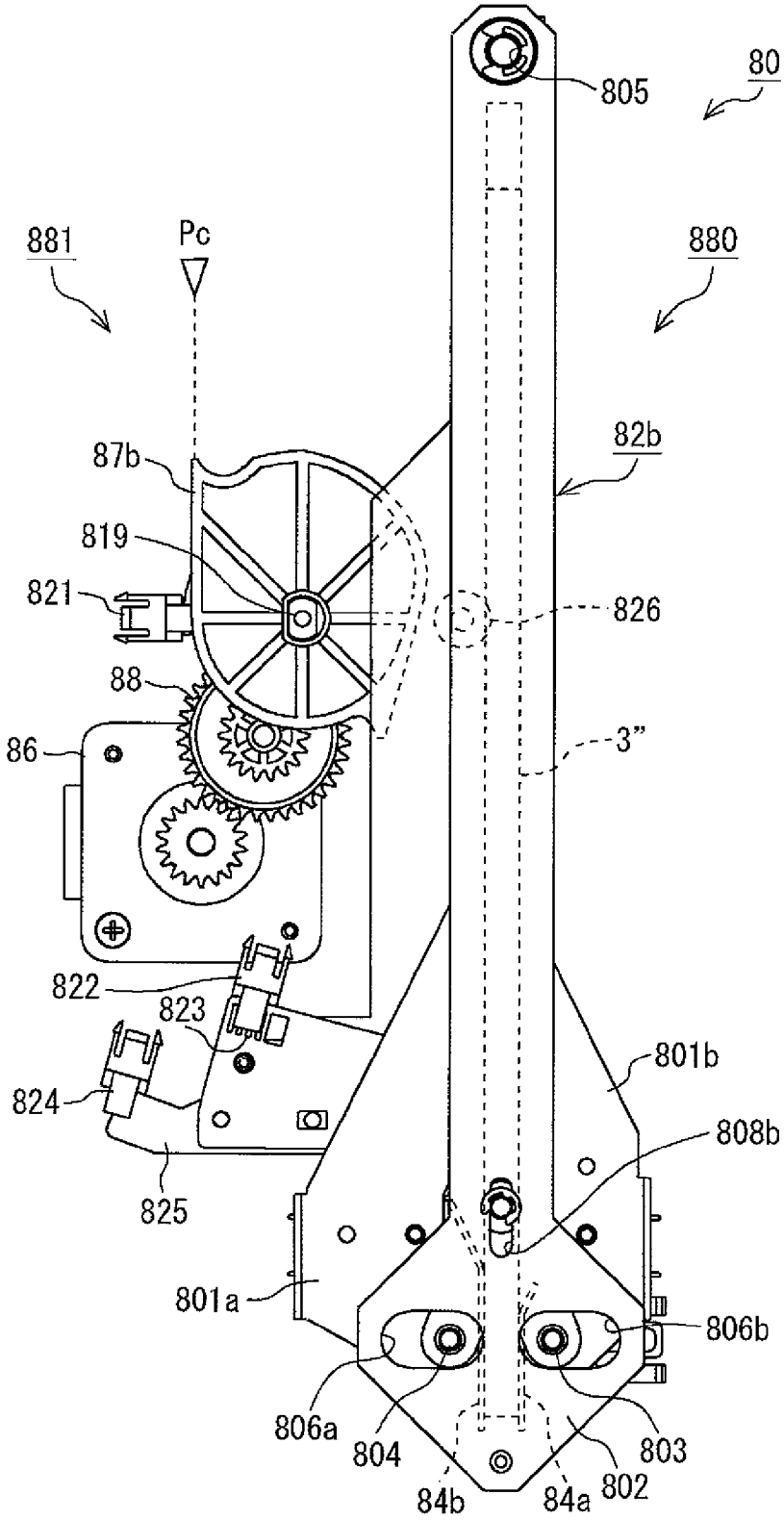
FIG. 16 is a front view showing the operation example (No. 3 thereof) at the time of alignment of the bundle of paper-sheets in the clamp movement mechanism 80.

According to the operation example (part three) when aligning a bundle of paper-sheets in the clamp movement mechanism 80 shown in FIG. 16, the clamps are locked again in a condition where the alignment pins are inserted into the aligned punched holes 3*a* in the bundle of paper-sheets 3". A case where the alignment pins 85*a* and 85*b* are pulled out of the bundle of paper-sheets 3" as shown in FIG. 14 will be described.

According to the clamp movement mechanism 80, the cams 87*a* and 87*b* stay in a condition where they have returned from the clamp releasing position (home position HP) to the cam retracting position Pc and their protrusions face right beside. In this condition, the motor 86 rotates reversely and transmits the motor torque to the cams 87*a* and 87*b* via the gear unit 88 in which rotation number is converted to a predetermined gear ratio. Then, it is based on a result such that the cams 87*a* and 87*b* have rotated by 90 degrees counterclockwise from the clamp releasing position (home position HP) to return to the cam retracting position Pc thereof.

Through the cam retracting operations, the clampers 82*a* and 82*b* take on predetermined postures at arbitrary positions in accordance with the thickness of the bundle of paper-sheets 3" owing to the urging force of the spring (not shown). For example, at the clampers 82*a* and 82*b*, respectively, the protrusion of the cam 87*a* does not press the roller 826 of the upper arm 801*b* of the clamper 82*a* and the protrusion of the cam 87*b* does not press the roller 826 of the upper arm 801*b* of the clamper 82*b*, thereby closing the clampers 82*a* and 82*b* synchronously with each other.

In the joint plates 801 and 802, the lower arm 801*a* and the upper arm 801*b* operate so as to be closed by using the fulcrum shaft member 805 as a movable reference. The driving force is transmitted to the lower shaft 804 movably attached to the lower arm 801*a* and the upper shaft 803 movably attached to the upper arm 801*b*. As a result thereof, the bundle of paper-sheets 3" may be held and fixed by the comb-shaped upper part pressing member 84*b* attached to the upper shaft 803 and the comb-shaped lower part pressing member 84*a* attached to the lower shaft 804.

Then, it is configured that the motor 89 is driven and its reverse-directional rotation movement is converted into a lowering movement by the alignment-pin-driving mechanism 91 shown in FIG. 7, thus pulling the alignment pins 85*a* and 85*b* out of the punched holes 3*a* in the bundle of paper-sheets 3". It is thus possible to hold and fix the bundle of paper-sheets 3" in a condition where the positions of the punched holes 3a therein are aligned. During these operations, the shutter 83 operates to limit the discharging of the bundle of paper-sheets 3" accumulated in the paper-sheet-reserving unit 32.

Figure 17:
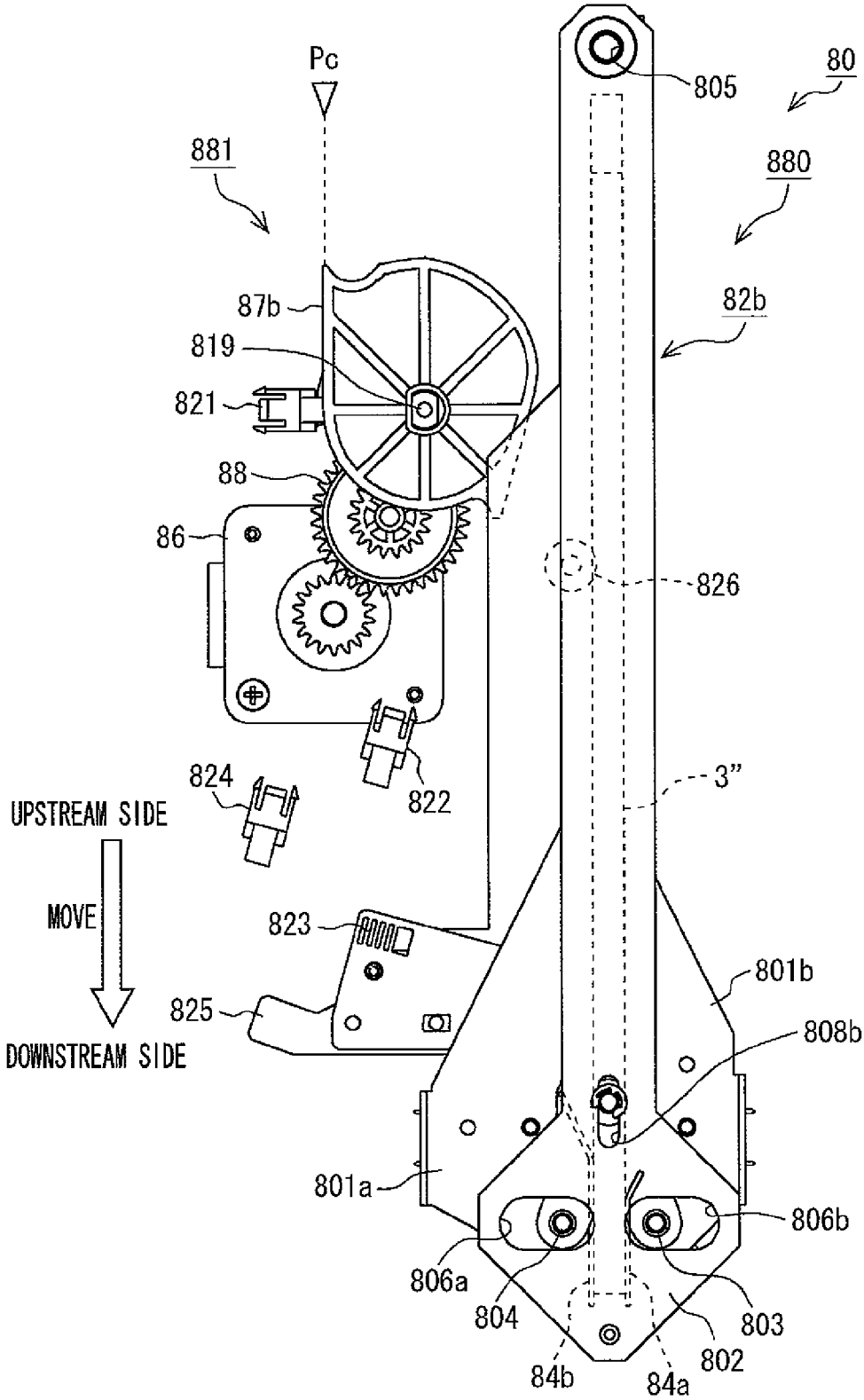
FIG. 17 is a front view showing the operation example (No. 4 thereof) at the time of alignment of the bundle of paper-sheets in the clamp movement mechanism 80.

According to the operation example (part four) when aligning the bundle of paper-sheets in the clamp movement mechanism 80 shown in FIG. 17, an example is referenced in which the clamped bundle of paper-sheets 3" is moved toward the downstream side. It is configured that in the clamp movement mechanism 80, only the paper-sheet fixation and movement section 880 is independent of the main body board 900, the right and left edge frames 92*a* and 92*b*, etc. shown in FIG. 7 and is moved toward the downstream side along the predetermined slide grooves 921 to 924. Immediately prior to this movement, the shutter 83 shown in the same figure is opened so as to be slid in a direction perpendicular to the direction in which the bundle of paper-sheets 3" are transported. It is thus possible to send to a next step the bundle of paper-sheets 3" that is accumulated in the paper-sheet-reserving unit 32 and has the punch holes 3*a* thereof realigned.

Figure 18:
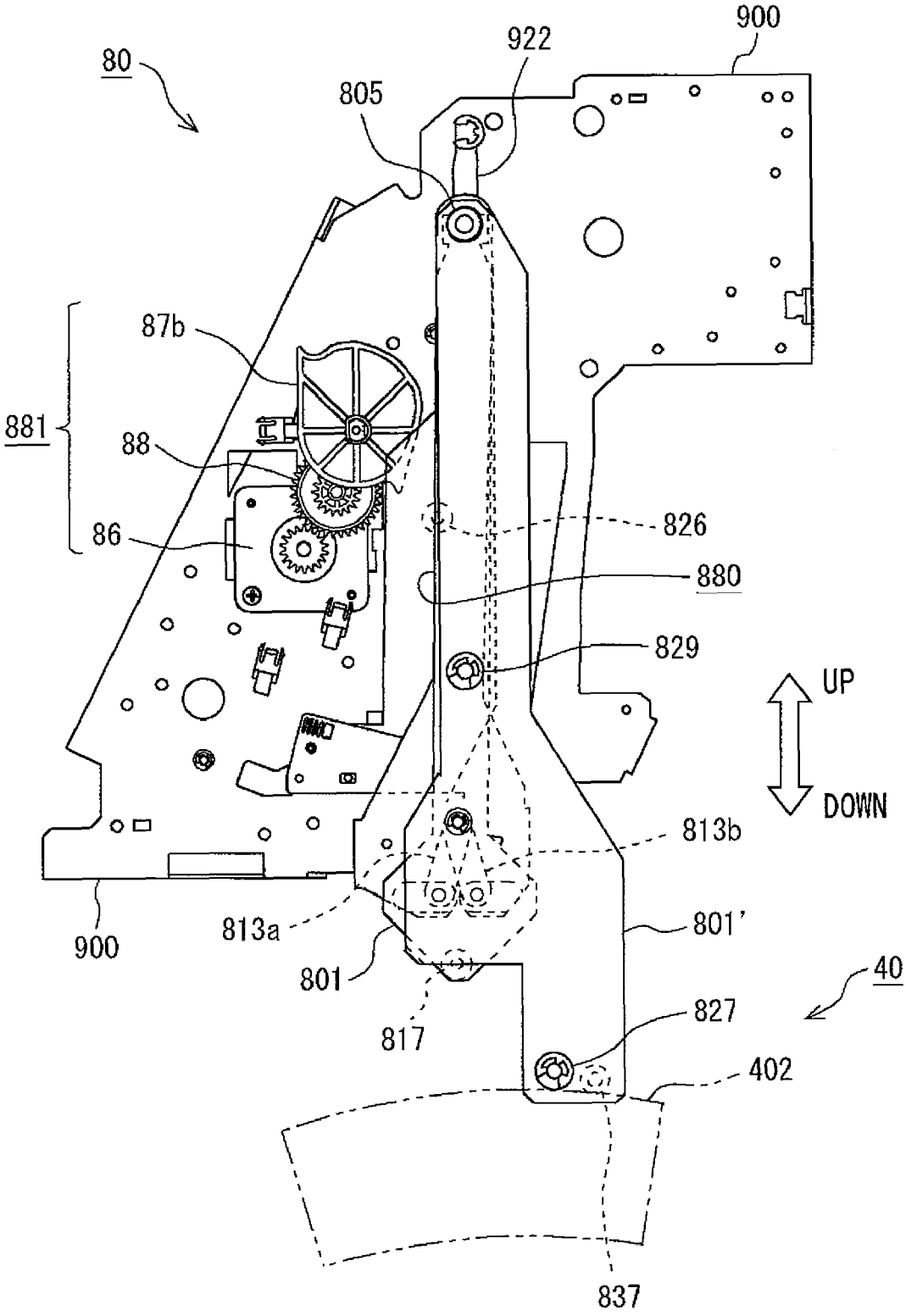
FIG. 18 is a front view supplementing a movement example of the paper-sheet fixation and movement section 880.

Here, a supplemental description will be given of a movement example of the paper-sheet fixation and movement section 880 with reference to FIG. 18. According to the paper-sheet fixation and movement section 880 shown in FIG. 18, a condition is shown in which it is independent of the main body board 900 and moved to the downstream side along the predetermined sliding grooves 921 through 924. This condition occurs when by descending the cam 402 having the fan shape of the binding process unit 40, the paper-sheet fixation and movement section 880 is separated from the clamp-opening-and-closing driving section 881 and drops by its weight. In this moment, the roller members 817 and 818 provided at the lower end of the paper-sheet fixation and movement section 880 are received by the openings 44*a* and 44*b* each having Y-shape provided on the forward end of the movement mechanism 41. The binding component 43 is then attached to the bundle of paper-sheets 3" by the movement mechanism 41 so that the movement mechanism 41 is retracted to a downward direction of the binder cassette 42 and the paper-sheet fixation and movement section 880 returns to its home position HP'.

Lifting power of the paper-sheet fixation and movement section 880 in this moment is given by the movement mechanism 41 of the binding process unit 40. For example, by lifting the cam 402 having the fan shape of the movement mechanism 41, the roller member 827 is lifted up. This causes the paper-sheet fixation and movement section 880 to return to its home position HP'. In order to discharge the booklet, the lower arms 801*a* and the upper arms 801*b* are then made movable.

The following will describe a configuration example of a control system of the binder paper alignment unit with reference to FIG. 19.

The motor drive units 35 and 36, the HP detection sensor 93 for the alignment pins, the upper end detection sensor 94, an HP sensor 115 for the press rollers, an HP sensor 117 for the curl fence, the paper-sheet detection sensor 119, a discharge roller drive unit 122, motor drive units 180 to 185, and the HP sensor 821 for clamping are connected to the control unit 50 shown in FIG. 19.

The paper-sheet detection sensor 119 detects the paper-sheet 3' discharged from the punch processing unit 20 and outputs a paper-sheet detection signal S19 to the control unit 50. Based on the paper-sheet detection signal S19, the control unit 50 controls the motor drive units 35 and 36 and the motor drive units 180 to 185. For example, it outputs a motor control signal S36 to the motor drive unit 36 based on the paper-sheet detection signal S19.

A discharge roller rotating motor 205 is connected to the discharge roller drive unit 122. The discharge roller drive unit 122 receives a motor control signal S22 from the control unit 50 to drive the motor 205 so that the discharge roller 25 may rotate. The paper-sheet 3' discharged from the punch processing unit 20 is transported by the rotation of the discharge roller 25 to come into the binder paper alignment unit 30.

The HP sensor 117 detects a position of any protrusions 342 on the curl fence unit 34*b* etc. and outputs a home position (hereinafter referred to as an HP) detection signal S17 to the control unit 50. The control unit 50 outputs a motor control signal S35 to the motor drive unit 35 based on the paper-sheet detection signal S19 and the HP detection signal S17.

A curl fence rotating motor 301 is connected to the motor drive unit 35. The motor drive unit 35 receives the motor control signal S35 from the control unit 50 to rotate the motor 301, thereby driving the curl fence units 34*a* and 34*b*. A paddle roller rotating motor 708 is connected to the motor drive unit 36. The motor drive unit 36 receives a motor control signal S36 from the control unit 50 to rotate the motor 708, thereby driving the paddle roller 37.

A motor 308 for the movement mechanism in the binding process unit 40 is connected to the motor drive unit 180. The motor drive unit 180 receives a motor control signal S80 from the control unit 50 to rotate the motor 308, thereby driving the movement mechanism 41. For example, it is configured that the clamp movement mechanism 80 opens the shutter 83 and lowers the fan-shaped cam 402 of the movement mechanism 41 so that the paper-sheet fixation and movement section 880 sandwiching the bundle of paper-sheets 3" can be lowered and moved to a next step. Then, it is configured that the paper-sheet fixation and movement section 880 rises and releases the bundle of paper-sheets 3" and closes the shutter 83 after the bundle of paper-sheets has been discharged.

The HP sensor 821 for clamping detects the clamp releasing position of the clamp movement mechanism 80. In the embodiment, it detects the home position HP of the cam 87*a* and 87*b* with respect to the home position (HP) of the clampers 82*a* and 82*b* or the like and outputs the cam HP detection signal S21 to the control unit 50. When aligning the bundle of paper-sheets, the control unit 50 controls the clamp member moving motor 86 via the motor drive unit 181 based on the cam HP detection signal S21.

The clamp member moving motor 86 is connected to the motor drive unit 181. The motor drive unit 181 receives a motor control signal S81 from the control unit 50 to drive the motor 86, thereby driving the clamp members such as the lower arm 801*a* and the upper arm 801*b* etc. When aligning the bundle of paper-sheets, the clamp members are opened. In the case of sandwiching the bundle of paper-sheets 3", the clamp members are closed.

The HP detection sensor 93 detects the home position HP of the alignment pins 85*a* and 85*b* and outputs a pin HP detection signal S93 to the control unit 50. The home position HP of the alignment pins 85*a* and 85*b* is referred to as a position brought down from the paper-sheet alignment surface by a predetermined distance. The alignment pins 85*a* and 85*b* are arranged to wait at this position. The upper end detection sensor 94 detects an upper end of the alignment pins 85*a* and 85*b* and outputs a pin top detection signal S94 to the control unit 50. When aligning the bundle of paper-sheets, the control unit 50 controls the pin member moving motor 89 via the motor drive unit 182 based on the pin HP detection signal S93 and the pin top detection signal S94.

The alignment pin driving motor 89 is connected to the motor drive unit 182. The motor drive unit 182 receives a motor control signal S82 from the control unit 50 to rotate the motor 89, thereby driving the decelerating gear 98, the UD rack 95, the link 96, the X-shaped arms 99*a* and 99*b*, the alignment pins 85*a* and 85*b*, etc. When aligning the bundle of paper-sheets, the alignment pins 85*a* and 85*b* are inserted into the punched holes 3*a* in the bundle of paper-sheets 3".

The motors 74*a* and 74*b* for the side jogger are connected to the motor drive unit 183. The motor drive unit 183 receives the motor control signal S83 from the control unit 50 to rotate the motors 74*a* and 74*b*, thereby driving the side jogger 70. It is configured that when aligning the bundle of paper-sheets, the width-aligning guide 72*a* and the width-aligning reference guide 72*b* of the side jogger 70 align the width direction of the bundle of paper-sheets 3". When discharging the bundle of paper-sheets, the width-aligning guide 72*a* and the width-aligning reference guide 72*b* are retracted.

The HP sensor 115 detects the position of the press rollers 38 and outputs a roller detection signal S15 to the control unit 50. Home position of the press rollers 38 is referred to as a position lifted from the paper-sheet alignment surface by a predetermined distance. The press rollers 38 are arranged to wait at this position. When discharging the bundle of paper-sheets, the control unit 50 controls the supply roller and the press rollers 38 based on the roller detection signal S15.

A press roller moving motor 814 is connected to the motor drive unit 184. The motor drive unit 184 receives a motor control signal S84 from the control unit 50 to rotate the motor 814, thereby driving the press rollers 38. A supply roller rotating motor 815 is connected to the motor drive unit 185. The motor drive unit 185 receives the motor control signal S85 from the control unit 50 to rotate the motor 815, thereby driving the supply roller 33. It is configured that when discharging the bundle of paper-sheets, the above-mentioned supply roller 33 and press rollers 38 send the bundle of paper-sheets 3" to a next step with a pressure being applied to it from its right surface and back surface sides.

Figure 20A:
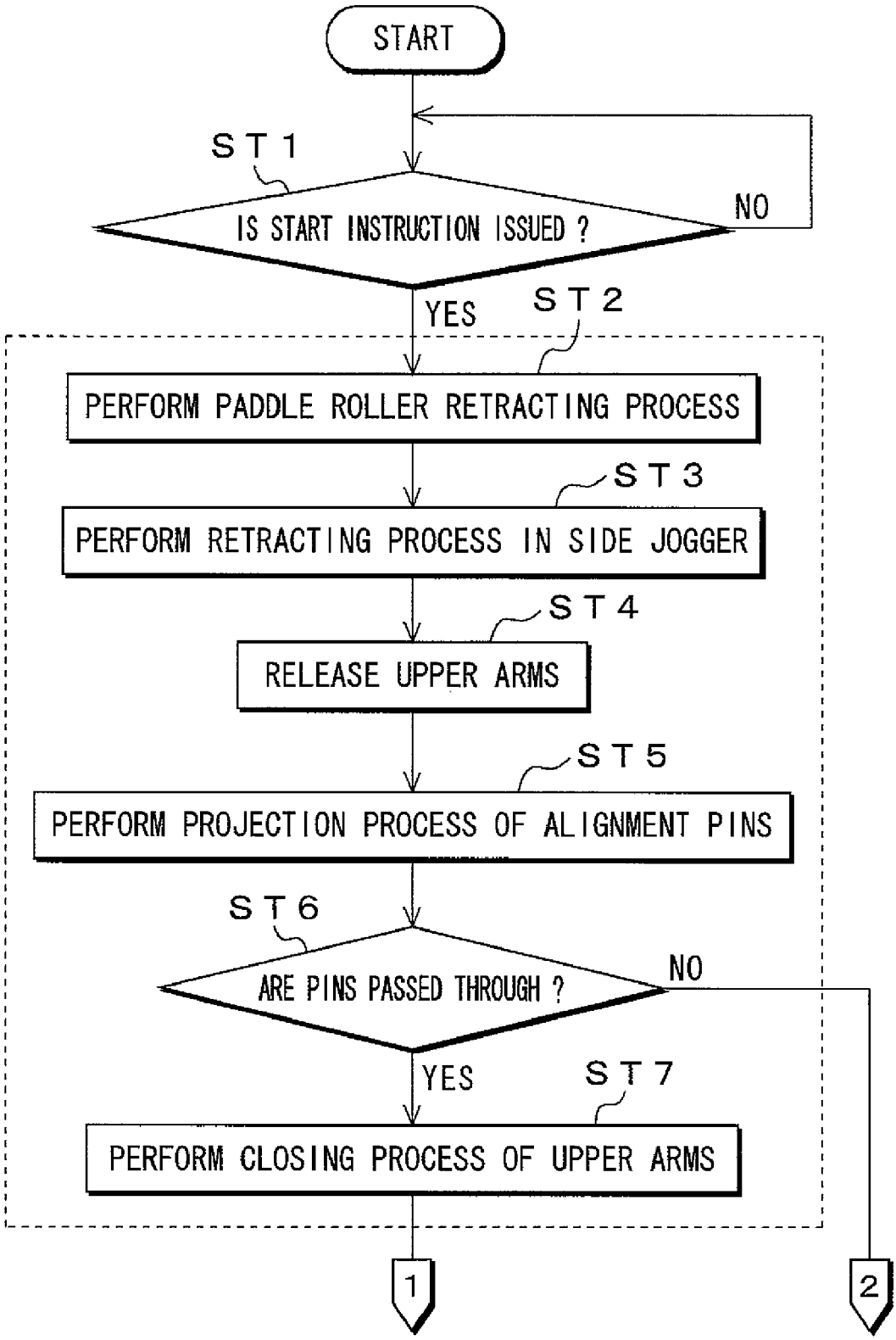
FIG. 20A is a flowchart showing a control example (No. 1) of the paper-sheet alignment and binding processing unit 110.
Figure 20B:
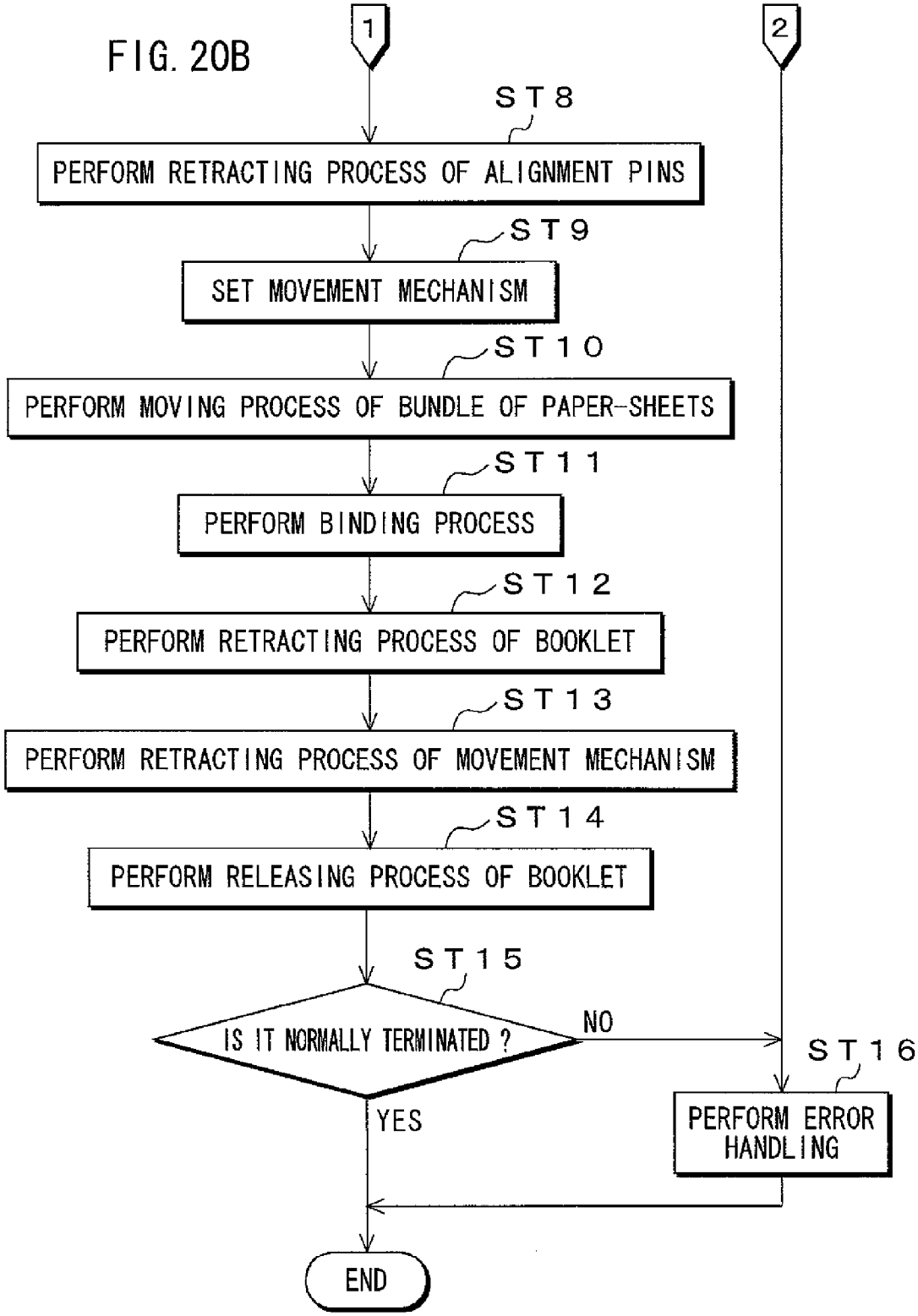
FIG. 20B is a flowchart showing the control example (No. 2) of the paper-sheet alignment and binding processing unit 110.

The following will describe a control example when aligning the paper-sheets in the paper-sheet-handling device 100 with reference to FIGS. 20A and 20B. In the embodiment, an assumption is that the paper-sheet fixation and movement section 880 performs the clamp-opening-and closing operation at its home position HP' when aligning the bundle of paper-sheets and the binding process unit 40 receives the binding component 43 from the binder cassette 42 and moves from the downward direction of the binder cassette 42 to the downward direction of the binder paper alignment unit 30 when moving the bundle of paper-sheets and only the paper-sheet fixation and movement section 880 drops by its weight from its home position HP' toward the retracting position of the cam 402. Then, a case is illustrated where the binding component 43 is bound to the bundle of paper-sheets 3" by the movement mechanism 41 so that the movement mechanism 41 retracts to the downward direction of the binder cassette 42 and the paper-sheet fixation and movement section 880 returns to its home position HP' so that the lower arms 801*a* and the upper arms 801*b* can be moved when discharging the booklet.

Under such control conditions, at step ST1 of a flowchart shown in FIG. 20A, it awaits for the pin alignment operation start instruction. If the start instruction is issued from the higher-order control system, at step ST2, the paddle roller 37 is retracted. Next, at step ST3, the width-aligning guide 72*a* and the width-aligning reference guide 72*b* in the side jogger 70 are retracted.

At step ST4, the upper arms 801*b* of the joint plates 801 and 802 are released up to a predetermined position thereof. In the embodiment, the lower arms 801*a* are fixed and only the upper arms 801*b* are driven. In the paper-sheet fixation and movement section 880, it is configured that the lower shaft 804 for the lower arms 801*a* is fitted and fixed into the V-shaped grooves 925 and 926 of the right-and left-edge frames 92*a* and 92*b* so that the lower arms 801*a* at right and left end sides are arranged to be flat-surfaced with the running surface of the paper-sheet-reserving unit 32.

Further, the upper arms 801*b* at right and left end sides are always urged toward their closing direction by the springs 816 and by the cam driving in the clamp-opening-and-closing driving section 881, the opening-and-closing operation is performed. In the embodiment, the clamp-opening-and-closing driving section 881 opens the upper arms 801*b* to the intermediate position thereof to facilitate the alignment of the bundle of paper-sheets 3". In this moment, the alignment pins 85*a* and 85*b* are retracted to the outside of the bundle-of-paper-sheets transporting path.

At step ST5, the control unit 50 performs the pin alignment by projecting the alignment pins 85*a* and 85*b* from the side of the lower arms 801*a* to the side of the upper arms 801*b*. In this moment, simultaneously with the projection of the alignment pins 85*a* and 85*b*, the upper arms 801*b* start opening operations. A movement occurs where the alignment pins 85*a* and 85*b* are inserted with relaxing the force by which the paper-sheets 3' are pressed. The upper arms 801*b* are opened up to an arbitrary intermediate position which is larger than a thickness of the booklet and smaller than the height of the bundle-of-paper-sheets-transporting path and are stopped there and they wait at this position until the upper end detection sensor 94 detects that the alignment pins 85*a* and 85*b* have reached the upper edge position thereof.

It is to be noted that the alignment pins 85*a* and 85*b* can be vibrated and/or the width-aligning guide 72*a* and the width-aligning reference guide 72*b* of the side jogger 70 also can be vibrated. This enables any frictional resistance in the paper-sheets 3' to be reduced, thereby allowing the alignment pins to be easily inserted into and passed through the punch holes 3*a* under the condition where the upper arms 801*b* are opened to perform the pin alignment.

At step ST6, the control unit 50 determines whether the alignment pins 85*a* and 85*b* have passed through the punched holes 3*a*. In the embodiment, the upper end detection sensor 94 monitors a lapse of time from the start of the projection of the alignment pins 85*a* and 85*b* until their arrival at the upper end. If the alignment pins 85*a* and 85*b* fail to reach the upper end within a predetermined lapse of time, a shift is made to pin alignment retry operations.

The pin top detection signal S94 is output from the upper end detection sensor 94 to the control unit 50. The control unit 50 determines whether the upper end detection sensor 94 has detected the alignment pins' upper end based on the pin top detection signal S94. If the upper end detection sensor 94 does not detect the alignment pins' upper end, a shift is made to step ST16 to perform error handling.

If the upper end detection sensor 94 has already detected the alignment pins' upper end at the above-mentioned step ST6, a shift is made to step ST7. At the step ST7, since the alignment pins 85*a* and 85*b* are inserted into the bundle of paper-sheets 3", the clampers 82*a* and 82*b* are closed. In this embodiment, the upper arms 801*b* are closed by retracting the cams 87*a* and 87*b* of the clamp-opening-and-closing driving section 881. It is thus possible to align the bundle of paper-sheets 3" surely by closing the clampers 82*a* and 82*b* under a condition where the alignment pins 85*a* and 85*b* reach the upper end thereof, namely, the alignment pins 85*a* and 85*b* are passed through.

Thus, when the upper arms 801*b* are moved toward the closure direction to complete the closure thereof, a shift is made to step ST8 shown in FIG. 20B where the alignment pins 85*a* and 85*b* are retracted. In this embodiment, the alignment pins 85*a* and 85*b* are retracted up to the lower end position thereof.

At step ST9, the control unit 50 then sets the movement mechanism 41 of the binding process unit 40 to the downward direction of the binder paper alignment unit 30. For example, the control unit 50 outputs the motor control signal S80 to the motor drive unit 180 to rotate the motor 308, thereby moving the movement mechanism 41 to a downward direction of the binder paper alignment unit 30. In this moment, the fan-shaped cam 402 keeps the roller member 827 engaged thereon.

At step ST10, it then brings down the paper-sheet fixation and movement section 880 sandwiching the bundle of paper-sheets 3" and a shift is made to a next step. In this embodiment, the clamp movement mechanism 80 opens the shutter 83 and in the binding process unit 40, the movement mechanism 41 moves to the downward direction of the binder paper alignment unit 30 and drives so as to bring down the fan-shaped cam 402.

Simultaneously as this cam-bring-down operation is made, the lower shaft 804 of the paper-sheet fixation and movement section 880 is disengaged from the V-shaped grooves 925 and 926 of the right-and-left-edge frames 92*a* and 92*b* so that the lower arms 801*a* become their free conditions and by moving the fan-shaped cam 402 of the movement mechanism 41 to the downward direction, only the paper-sheet fixation and movement section 880 sandwiching the bundle of paper-sheets 3" drops by its weight.

In this moment, the paper-sheet fixation and movement section 880 is separated from the driving of the cams 87*a* and

87*b* of the clamp-opening-and-closing driving section 881 at a point of time when it start moving to the binding process unit 40. This causes the clampers 82*a* and 82*b* to be always closed by urging force of the spring 816 so that only the paper-sheet fixation and movement section 880 can move to the binding process unit 40 with it sandwiching the bundle of paper-sheets 3".

At step ST11, the movement mechanism 41 then performs binding process on the bundle of paper-sheets 3". In this moment, the motor drive unit 180 rotates the motor 308 based on the motor control signal S80 received from the control unit 50, thereby attaching the binding component 43 on the bundle of paper-sheets 3". The bundle of paper-sheets 3" after the binding process is performed thereon becomes a booklet 90. Thereby, the alignment and binding processes of the bundle of paper-sheets 3" are completed.

At step ST12, a retracting process of the booklet 90 is then performed. In this moment, the control unit 50 outputs the motor control signal S80 to the motor drive unit 180 to rotate the motor 308, thereby lifting the paper-sheet fixation and movement section 880 sandwiching the booklet 90.

For example, the shutter 83 is still opened by the clamp movement mechanism 80 and the binding process unit 40 drives so as to lift the fan-shaped cam 402. Simultaneously as this cam-lifting operation is made, the lower shaft 804 of the paper-sheet fixation and movement section 880 come into the V-shaped grooves 925 and 926 of the right-and-left-edge frames 92*a* and 92*b* so that the lower arms 801*a* become their restraint condition.

By lifting the fan-shaped cam 402 upward, the paper-sheet fixation and movement section 880 sandwiching the booklet 90 is returned to its home position HP. In this moment, the paper-sheet fixation and movement section 880 is engaged with the cams 87*a* and 87*b* of the clamp-opening-and-closing driving section 881 at a point of time when it finishes returning to the binder paper alignment unit 30. It is thus possible to perform the opening-and-closing operation again on the paper-sheet fixation and movement section 880 with sandwiching the booklet 90 by the clampers 82*a* and 82*b* which become their closed conditions by urging force of the springs 816 by means of the binder paper alignment unit 30.

At step ST13, the retracting process of the movement mechanism 41 is then performed. In this embodiment, simultaneously as the above-mentioned return of the paper-sheet fixation and movement section 880 is made, the movement mechanism 41 is moved from the downward direction of the binder paper alignment unit 30 to the downward direction of the binder cassette 42. In this moment, the fan-shaped cam 402 is still attached on the roller member 827. It is configured that the control unit 50 outputs the motor control signal S80 to the motor drive unit 180 to rotate the motor 308, thereby moving the movement mechanism 41 from the downward direction of the binder paper alignment unit 30 to the downward direction of the binder cassette 42.

At step ST14, the releasing process of the booklet 90 held at the home position HP is then performed. In this embodiment, the shutter 83 is still opened so that the clamp-opening-and-closing driving section 881 drives the cams 87*a* and 87*b* to open the upper arms 801*b*, thereby releasing the booklet 90. The booklet 90 drops by its weight onto the releasing unit 60 because the clampers 82*a* and 82*b* are opened.

Thereafter, at step ST15, the control unit 50 determines whether or not the booklet 90 is normally released. As standard for judging this, it is configured that a period of predetermined time relating to the release of the booklet 90 is monitored and if exceeding this, it is determined that the booklet 90 is not normally released. If the booklet 90 is normally released, paper-sheets-alignment-and-paper-sheets-binding-and-releasing control is normally terminated.

It is to be noted that if the alignment pins' upper end cannot be detected by the upper end detection sensor 94 even after the predetermined lapse of time elapses at the above-mentioned step ST6 and if the booklet 90 is not normally released at the step ST15, a shift is made to step ST16 to perform error handling because a case where any jam or the like occurs is supposed. For example, it is configured that an error display processing may be performed on a display unit (not shown) to indicate causes of the error or the like. In a second embodiment, it is configured that a jam process for the paper-sheets 3' that fail to be aligned, the booklet that does not drop, and the like is performed.

In such a manner, according to the paper-sheet-handling device 100 according to the Embodiment 1, when moving the bundle of paper-sheets 3" obtained by binding a plurality of paper-sheets 3', the clamp-opening-and-closing driving section 881 keeps the clamp opened condition in which it exceeds the urged force of the springs 816 against the respective upper arms 801*b* in the paper-sheet fixation and movement section 880. Under this condition, it is configured that a plurality of paper-sheets 3' is bound to obtain the bundle of paper-sheets 3" so that the paper-sheet fixation and movement section 880 can be moved independently from the clamp-opening-and-closing driving section 881 with the bundle of paper-sheets 3" being fixed.

Thus, the binder paper alignment unit 30 can have a configuration such that it is split into the paper-sheet fixation and movement section 880 and the clamp-opening-and-closing driving section 881, thereby enabling the bundle of paper-sheets 3" to be easily moved to the binding step or the like with it being fixed by the paper-sheet fixation and movement section 880 mounting any necessary minimal mechanical parts.

Further, it is possible to make a movement area (a dead space) of the clamp movement mechanism 80 less and to make a structure of the paper-sheet alignment and binding processing unit 110 more compact and simpler as compared with a method of moving the clamp-opening-and-closing driving section 881 mounted on the paper-sheet fixation and movement section 880 by another means for every clamp movement mechanism to transport the bundle of paper-sheets 3" to the binding unit or a method of performing a ring binding process by moving the binding component 43 and the movement mechanism 41 of the binding process unit 40 to a predetermined position without moving the bundle of paper-sheets 3".

In this connection, it is possible to make component parts and a control sequence for the clamp movement mechanism simpler as compared with a case where the clampers 82*a* and 82*b* are directly connected to a stepping motor or the like and driven thereby and the positions of the clampers 82*a* and 82*b* alter based on a thickness of the bundle of paper-sheets or a case where the paper-sheet transporting surface of the paper-sheet reserving unit 32 can be configured so as to rise and fall and the bundle of paper-sheets 3" is controlled so as to prevent it from being bent in accordance with the number of stacked paper-sheets 3'.

Further, the harness processing is unnecessary because any movement of an electric part such as the motor 86 and the HP sensor 821 is not accompanied when moving the bundle of paper-sheets, thereby allowing a structure of the clamp movement mechanism 80 to be simplified. Further, since the lower arms 801*a* are fixed so as to be flat-surfaced with the paper-sheet transporting surface when aligning the bundle of paper-sheets and the upper arms 801*b* are opened, it is possible to align pieces of paper accurately with any curl in the paper-sheets 3' being corrected by the paper-sheet curl pressing mechanism 31. This enables the paper-sheets 3' to be aligned along the transporting surface, thereby allowing any stable paper alignment to be performed.

Embodiment 2

Figure 21:
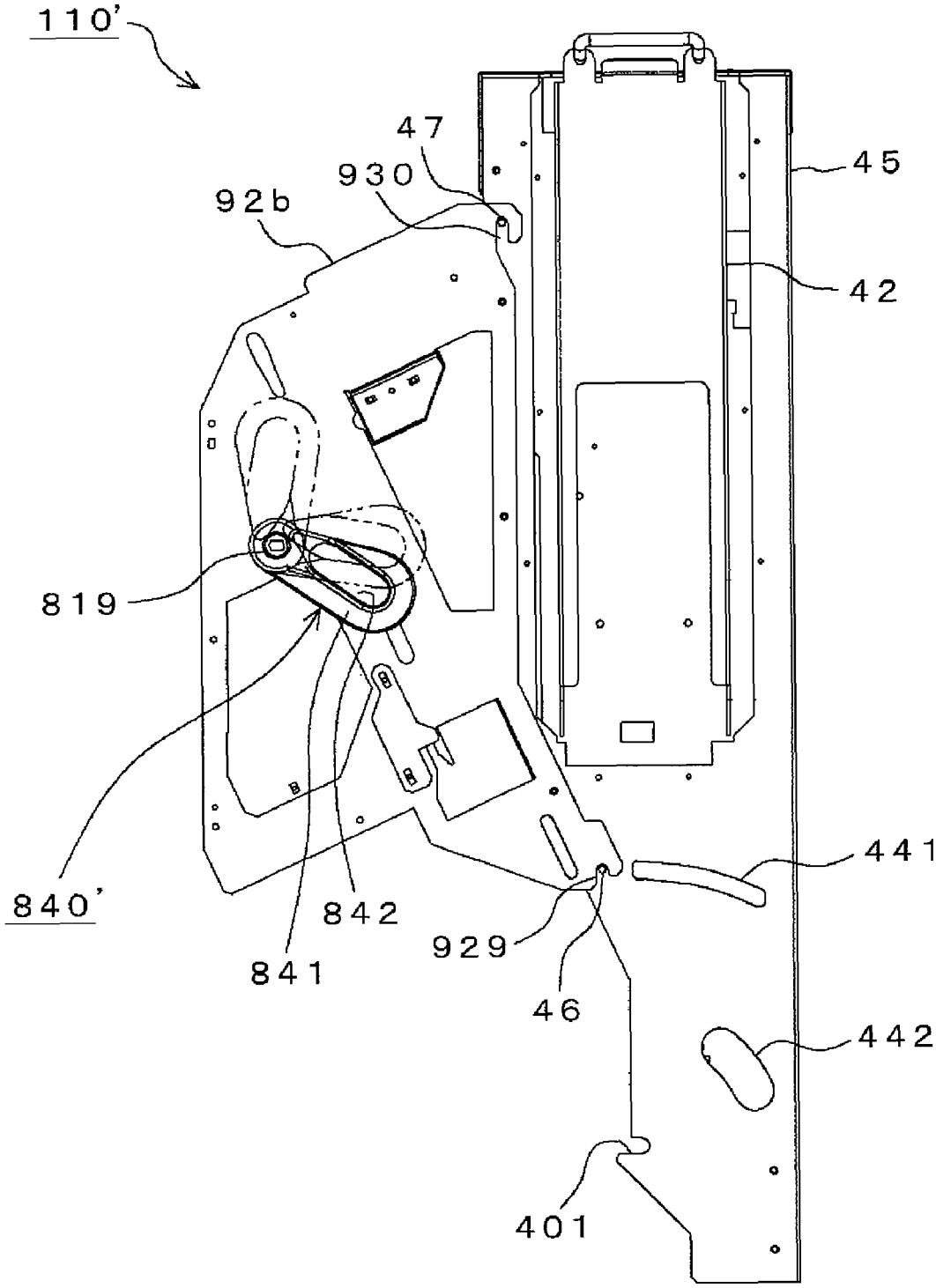
FIG. 21 is a front view showing a configuration example of paper-sheet alignment and binding processing unit 110' in a paper-sheet-handling device 100 as a second embodiment.

The following will describe a configuration example of a paper-sheet alignment and binding processing unit 110' in a paper-sheet-handling device 100 as a second embodiment with reference to FIG. 21. According to the paper-sheet alignment and binding processing unit 110' shown in FIG. 21, the clamp movement mechanism 80 is provided with a manipulation lever for opening the clamp (hereinafter, referred to as "clamp lever 840'").

The clamp lever 840' is used when performing the error handling at the step ST16 of the first embodiment. For example, when aligning the bundle of paper-sheets, the clamp lever 840' is manipulated if the jam process for the paper-sheets 3' that fail to be aligned, the booklet that does not drop, and the like is performed. The clamp lever 840' is attached to the cam cooperative member 819 constituting a shaft for the cams in the clamp-opening-and-closing driving section 881. For example, the cam cooperative member 819 extends to a front side thereof and the clamp lever 840' is attached onto a shaft of the corresponding cam cooperative member 819.

The hook-type clamp lever 840' shown in FIG. 21 is different from the handle-type clamp lever 840 shown in FIG. 2 in shape. For the lever member, hard resin is used and the one formed by injection-molding this hard resin is used. The clamp lever 840' has a main body 841 which has a long opening in a middle portion of the main body 841. It is manipulated when releasing the clamp that if a manipulation is made by a right hand, the index finger through the little finger thereof are inserted into the long opening 842 and are gripped so as to bring the clamp lever 840' down.

Figure 22:
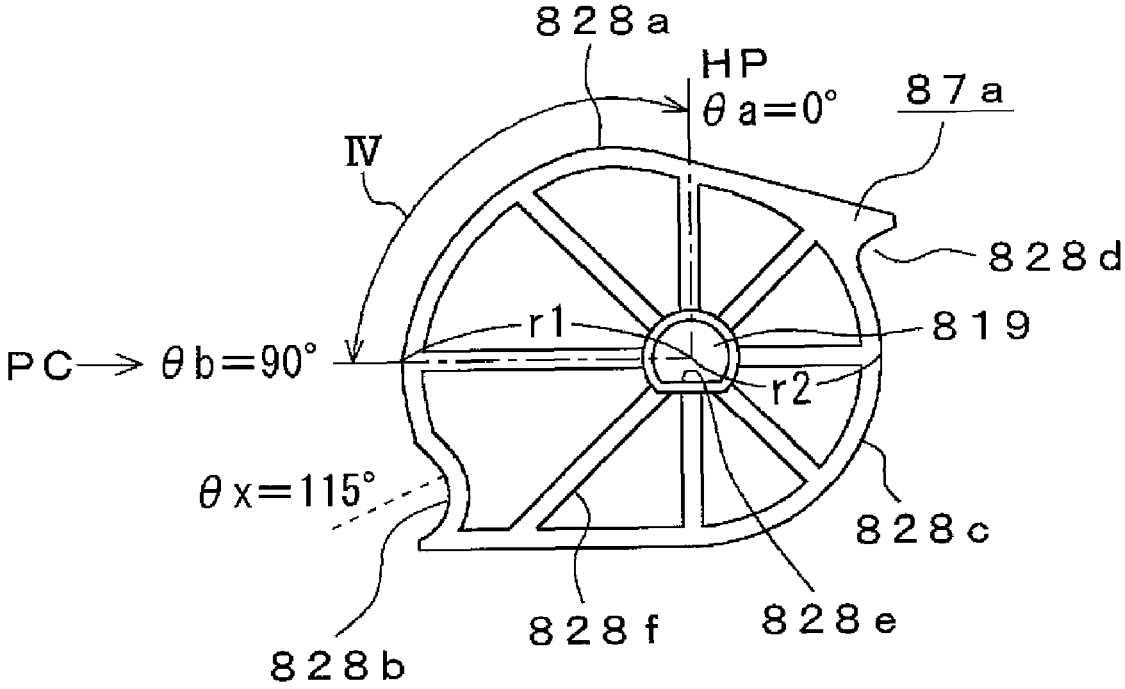
FIG. 22 is a configuration diagram showing an operation range example of a cam 87*a* or the like of the clamp movement mechanism 80 in the paper-sheet alignment and binding processing unit 110'.

In this embodiment, shown in FIG. 22, when a lever angle θa is set to 0 degrees(θa=0°) as the home position HP of the clamp lever 840', a lever angle θb becomes 90 degrees (θb=90°) and relates to the home position PC of the cam 87*a* or 87*b* attached to the cam cooperative member 819 which is provided with the clamp lever 840' shown in FIG. 21. The clamp-opening -and-closing driving section 881 drives the cam cooperative member 819 between the lever angle θa and the lever angle θb (hereinafter, referred to as "normal operation range IV"). A lever angle θx that is a lever angle at its lock position for opening the clamp is, for example, 115 degrees (θx=115°).

When such a clamp lever 840' is provided, the lever angle θx of the lock position for opening the clamp and the lever angle θa or θb within the normal operation range IV of the cams 87*a* and 87*b* are made different from each other and unless the clamp lever 840' is rotated up to its released position, a situation where a front cover or the like of the corresponding paper-sheet handling device cannot be closed occurs. In other words, it is possible to bring the clamp lever 840' into an interference scheme when closing the cover so that by setting such a structure, it is possible to prevent the lock releasing from being forgotten.

The following will describe an example of an operation range of the cam 87*a* or the like in the clamp movement mechanism 80 with reference to FIG. 22. According to a cam shape in this embodiment, it is configured that the lock position for opening the clamp is set to a position that is different from that within the normal operation range IV of the cams 87*a* and 87*b* for opening and closing the clamp.

The cam 87*a* (87*b* is not shown) for bring the clamp up or down (U/D) shown in FIG. 22 has a deformed ellipse shape, is fixed to the cam cooperative member 819 and is provided with curved parts (parts having a given shape) 828*a* and 828*c* and U-shaped (hollowed) parts 828*b* and 828*d*.

The cam 87*a* has a shaft hole 828*e* to which the cam cooperative member 819 is engaged. The curved part 828*a* includes, for example, a side having an arc of a circle, which is based on a first radius r1 around the shaft hole 828*e*, and a side having a straight level, which extends from the side having the arc of the circle as well as the curved part 828*c* includes a side having an arc of a circle, which is based on a second radius r2 (r2<rl) around the shaft hole 828*a*, and a side having a straight level, which extends from the side having the arc of the circle.

A boundary between a terminal end of the side having the arc of the circle in the curved part 828*a* and the side having the straight level in the curved part 828*c* forms a projection. Inside this projection, the U-shaped part 828*b* is formed. A boundary between a terminal end of the side having the arc of the circle in the curved part 828*c* and the side having the straight level in the curved part 828*a* forms a projection. Inside this projection, the U-shaped part 828*d* is formed.

In this embodiment, the above-mentioned curved parts 828*a* and 828*c* and U-shaped parts 828*b* and 828*d* are supported by the spoke parts 828*f*. The cams 87*a* and 87*b* are produced as, for example, a resin-made part or a light-alloy-made part.

It is configured that the curved part 828*a* defines the normal operation range IV where the upper arms 801*b* is moved to a predetermined position with respect to the lower arms 801*a* as shown in FIG. 17 to release the bundle of paper-sheets 3".

It is configured that the U-shaped part 828*b* is provided so as to be continuous with the curved part 828*a* and defines the lock position for opening the clamp. In this embodiment, the U-shaped part 828*b* has a dropping function to drop the roller 826 engaged with the upper arm 801*b* thereto at a position (θx=115°) rotated further from the normal operation range IV.

In this embodiment, within the figure, when a lever angle θa is set to 0 degrees (θa=0°) as the home position HP of the clamp lever 840', a lever angle θb becomes 90 degrees (θb=90°) and relates to the home position HP of the cam 87*a* or 87*b*. The lever angle θx is 115 degrees (θx=115°) and is a position where the clamp lever 840' is further rotated from the home position PC of the cams 87*a* and 87*b* by an angle of about 25 degrees (=115°−90°). By providing with such a U-shaped part 828*b*, it is possible to keep an opened condition of each of the upper arms 801*b* in the clampers 82*a* and 82*b*.

Here, a description will be given of an operation example of the cam 87*b* or the like when the clamp lever 840' is manipulated in the binder paper alignment unit 30 with reference to FIG. 23.

Figure 23:
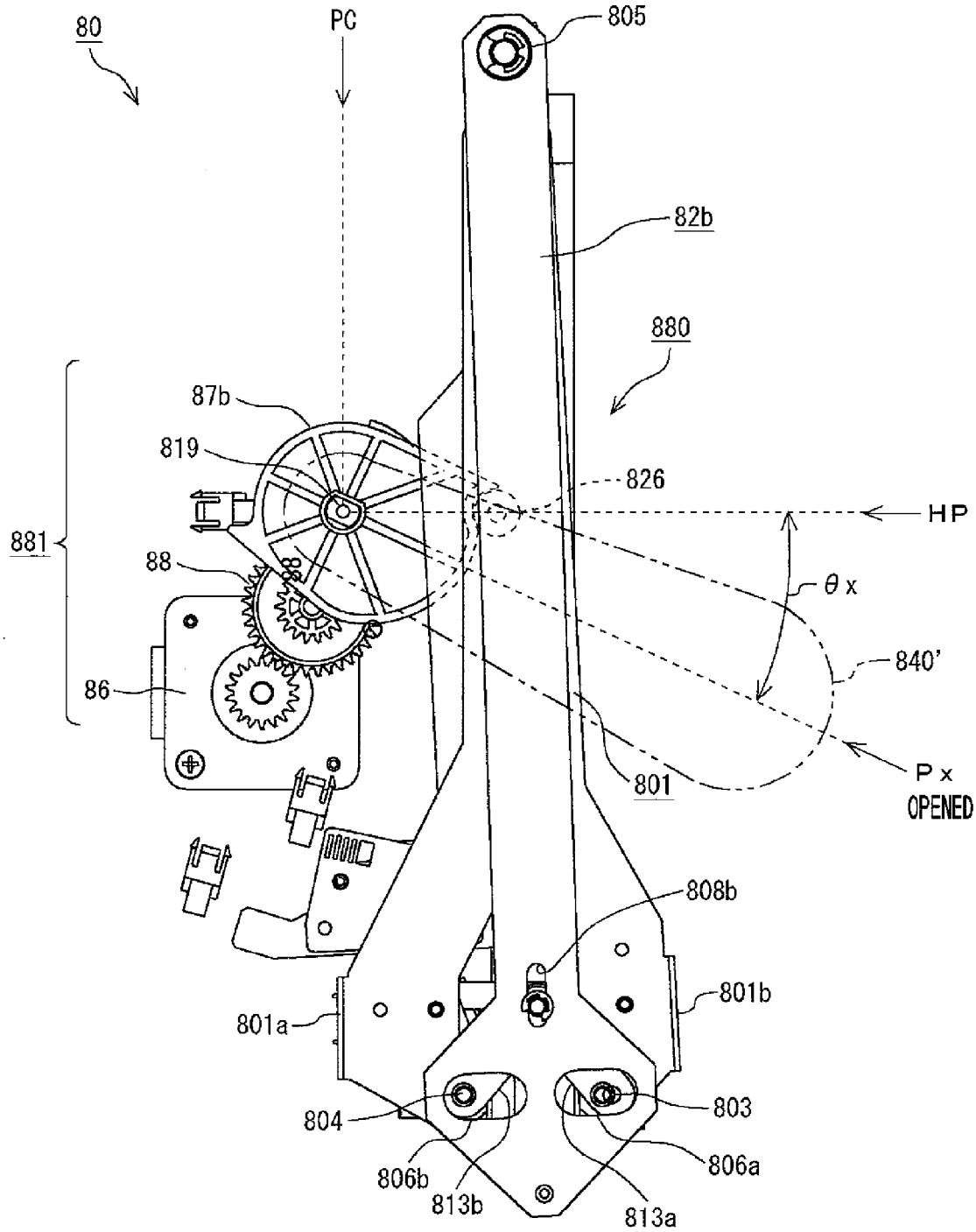
FIG. 23 is a front view illustrating an operation example of the cam 87*a* or the like when manipulating a lever.

According to the clamp movement mechanism 80 in the binder paper alignment unit 30 shown in FIG. 23, the clamp-opening-and-closing driving section 881 that drives the upper arms 801*b* is provided and the clamp-opening-and-closing driving section 881 is provided with the cams 87*a* and 87*b* for opening and closing the clamp. The upper arms 801*b* are provided with the rollers 826 for opening and closing the clamp, which are engaged with the cams 87*a* and 87*b*.

In this embodiment, it is configured that when a message such as "Please remove the jam by manipulating the clamp lever" is displayed during a period of the error handling time at the step ST16 of the flowchart shown in FIG. 20B, a user opens a front cover, not shown, or the like to manipulate the clamp lever 840'. In this moment, the cam cooperative member attached to the clamp lever 840' rotates so that the cams 87*a* and 87*b* fixed to the cam cooperative member 819 rotate and the rollers 826 of the upper arms 801*b* drop to the U-shaped parts 828*b* that are continuous with the curved parts 828*a*. Under this condition, the user carries out any jam-removing operation.

Thus, it is possible to make the lever angle θx on the lock position for opening the clamp and the lever angles θa and θb of the cams 87*a* and 87*b* within the normal operation range IV, as shown in FIG. 22, different from each other. After completion of the jam-removing operation, the user operates to return rotation of the clamp lever 840' from an opened position Px to the home position HP. This is because a situation occurs where the front cover of the corresponding paper-sheet handling device cannot be closed if the clamp lever 840' is not returned to the home position HP.

Thus, according to the paper-sheet-handling device 200 relating the second embodiment, when transporting the bundle of paper-sheets 3" obtained by binding a plurality of paper-sheets 3', the clamp-opening-and-closing driving section 881 is provided with the cams 87*a* and 87*b* for opening and closing the clamp so that when releasing the bundle of paper-sheets, the cams 87*a* and 87*b* move the upper arms 801*b* to a predetermined position with respect to the lower arms 801*a* by a designated curved part 828*a* defining the normal operation range IV to release the bundle of paper-sheets 3". Further, when an error or the like occurs, with manipulating the clamp lever 840', by rotating the cams 87*a* and 87*b* to the U-shaped parts 828*b* that are continuous with the curved parts 828*a*, it is possible to make the rollers 826 of the upper arms 801*b* drop to the U-shaped parts 828*b*.

Therefore, it is possible to lock the clamp movement mechanism 80 under the condition where the upper arms 801*b* are opened. This enables the jam-removing operation to be performed with the upper arms 801*b* being opened, thereby improving the operability when handling the error. Furthermore, since the lock position for opening the clamp is set to a position that is different from the normal operation range IV, the clamp lever 840' can be an interference when the cover is closed. Employing such a clamp manipulation configuration enables release of the lock to be prevented from being forgotten. Furthermore, it is possible to reduce a burden of the control unit 50 as compared with a case where the detection of the lock position is performed utilizing the position sensor for the cams 87*a* and 87*b* and forgetting the release of the lock is informed to the user.

It has been explained in the above-mentioned embodiments 1 and 2 with respect to a case in which with reference to the up and down movement of the paper-sheet fixation and movement section 880 for moving the bundle of paper-sheets 3", it is driven by the fan-shaped cam 402 through the movement mechanism 41, but it is not limited by this: whole of the paper-sheet fixation and movement section 880 is connected by a belt or a rack and pinion, and it may be moved by other driving means.

INDUSTRIAL APPLICABILITY

This invention is very preferable to be applied to a binding device for carrying out the binding processing to the recording paper-sheets released from a copy machine or a print machine for black-and-white use and for color use.

The invention claimed is:

1. A paper-sheet handling device that transports a bundle of paper-sheets obtained by binding a plurality of paper-sheets, comprising a paper-sheet fixation and movement mechanism that includes:

a main body member;

a right side clamper comprising a right side fixed clamp member and a right side movable clamp member at a right end side of the main body member;

a left side clamper comprising a left side fixed clamp member and a left side movable clamp member at a left end side of the main body member;

a clamp-opening-and-closing driving section that drives said right side and left side movable clamp members at the right and left end sides, said clamp-opening-and-closing driving section being attached to said main body member; and a paper-sheet fixation and movement section that is movably attached to said main body member and transports said bundle of paper-sheets, the paper-sheet fixation and movement section being attached to said main body member separately from said clamp-opening-and-closing driving section, and wherein said paper-sheet fixation and movement mechanism has a first operating condition in which the paper-sheet fixation and movement section is engaged with clamp-opening-and-closing driving section when aligning the bundle of paper-sheets, and a second operating condition in which the paper-sheet fixation and movement section is disengaged from the clamp-opening-and-closing driving section when moving the bundle of paper-sheets.

2. The paper-sheet handling device according to claim 1, wherein said paper-sheet fixation and movement section contains urging members that urge said movable clamp members towards the fixed clamp members to keep the right and left side clampers in a clamp-closed situation.

3. The paper-sheet handling device according to claim 1, wherein in the first operating condition of the paper-sheet fixation and movement mechanism said clamp-opening-and-closing driving section exerts a force against the movable clamp members to keep the right and left side clampers in a clamp-opened situation.

4. The paper-sheet handling device according to claim 1, wherein said paper-sheet fixation and movement mechanism drives said movable clamp members for every paper-sheet or for every plural paper-sheets to close it when aligning the bundle of paper-sheets.

5. The paper-sheet handling device according to claim 4, wherein said paper-sheet fixation and movement mechanism moves said paper-sheet fixation and movement section to a binding step for each bundle of paper-sheets after the bundle of paper-sheets is aligned.

6. The paper-sheet handling device according to claim 1, wherein said paper-sheet fixation and movement mechanism is provided with a right base plate and a left base plate for attaching the clamp members at the right end side and the left end side respectively of said main body member, each base plate having a predetermined shape and containing a shaft hole at one end thereof and an elongated hole and first and second limiting holes at predetermined positions at the other end thereof, wherein a pantograph structure is formed such that fulcrums shared by an end of said right side fixed clamp member and an end of said right side movable clamp member are engaged with the shaft hole in said right base plate via a fulcrum shaft member and fulcrums shared by an end of said left side fixed clamp member and an end of said left side movable clamp member are engaged with the shaft hole in said left base place via the fulcrum shaft member, a first shaft provided on the other end of said right side fixed clamp member and the other end of said left side fixed clamp member engages the first limiting hole at said other end of the left base plate and the first limiting hole at said other end of the right base plate, a second shaft provided on the other end of the right side movable clamp member and the other end of the left side movable clamp member engages the second limiting hole at said other end of the left base plate and the second limiting hole at said other end of the right base plate, said first and second shafts are respectively engaged with one end of a right side pair of isometric link members at the right end side of the main body member and said first and second shafts are respectively engaged with one end of a left side pair of isometric link members at the left end side of the main body, and the other ends of said left side isometric link members are engaged with said elongated hole of the left base plate via a left side engaging member and the other ends of said right side isometric link members are engaged with said elongated hole of the right base plate via a right side engaging member.

7. The paper-sheet handling device according to claim 6, wherein a roller member for guiding said bundle of paper-sheets to a predetermined binding position of a next step is provided at a forward end side of each base plate for attaching the clamp members.

8. The paper-sheet handling device according to claim 6, wherein said main body member comprises right and left frame members, respectively, at right and left end sides of the main body member;

the right and left frame members include groove portions at predetermined positions;

the first shaft provided on the other ends of said fixed clamp members is engaged with said groove portions when aligning the bundle of paper-sheets; and the first shaft provided on the other ends of said fixed clamp members is disengaged from said groove portions when moving the bundle of paper-sheets.

9. The paper-sheet handling device according to claim 6, comprising a roller member attached to each base plate and wherein, on each side of the main body member, each roller member, each engaging member of the isometric link members of said base plate and each shaft hole at one end of said base plate are positioned so as to be aligned with each other.

10. The paper-sheet handling device according to claim 6, comprising:

a roller member attached to each base plate, and a processing unit at a downstream side of said paper-sheet fixation and movement mechanism for mounting a binding member on the bundle of paper-sheets, and wherein said processing unit is provided with engaging portions that receive the roller members for guiding the processing unit to a binding position relative to said paper-sheet fixation and movement mechanism.

* * * * *